US012179122B2

(12) United States Patent
Bevis, Jr.

(10) Patent No.: US 12,179,122 B2
(45) Date of Patent: Dec. 31, 2024

(54) MECHANICAL ADVANTAGE DEVICE

(71) Applicant: People Levers LLC, Groton, MA (US)

(72) Inventor: John H. Bevis, Jr., Groton, MA (US)

(73) Assignee: People Levers LLC, Groton, MA (US)

( * ) Notice: Subject to any disclaimer, the term of this patent is extended or adjusted under 35 U.S.C. 154(b) by 0 days.

(21) Appl. No.: 18/768,826

(22) Filed: Jul. 10, 2024

(65) Prior Publication Data

US 2024/0359109 A1 Oct. 31, 2024

Related U.S. Application Data

(60) Division of application No. 18/425,658, filed on Jan. 29, 2024, now Pat. No. 12,064,702, which is a continuation-in-part of application No. 18/133,370, filed on Apr. 11, 2023, now Pat. No. 11,883,756.

(60) Provisional application No. 63/362,871, filed on Apr. 12, 2022.

(51) Int. Cl.
*A63G 11/00* (2006.01)
*A63G 13/08* (2006.01)

(52) U.S. Cl.
CPC ..... *A63G 11/00* (2013.01)

(58) Field of Classification Search
CPC ..... A63G 11/00; A63G 13/00; A63G 13/08; A63B 21/04
USPC ..... 472/106, 110
See application file for complete search history.

(56) References Cited

U.S. PATENT DOCUMENTS

| | | | |
|---|---|---|---|
| 1,317,231 | A | 9/1919 | SeeSaw |
| 1,432,746 | A | 10/1922 | Downey |
| 1,586,254 | A | 5/1926 | Lovejoy |
| 2,201,036 | A | 5/1940 | Guerrier |
| 2,544,106 | A | 3/1951 | Ray |
| 2,726,085 | A | 12/1955 | Brand |
| 2,873,118 | A | 2/1959 | Dimitriadis |
| 2,919,131 | A | 12/1959 | Dimitriadis |
| 3,051,481 | A | 8/1962 | Johnson |
| 3,140,869 | A | 7/1964 | Pacuk |
| 3,514,103 | A | 5/1970 | Lieberman |
| 3,822,881 | A | 7/1974 | Douglass et al. |
| 4,218,936 | A | 8/1980 | Waggoner |
| 5,403,239 | A | 4/1995 | Zimmers |
| 5,547,425 | A | 8/1996 | Krhs et al. |
| 5,776,002 | A | 7/1998 | Weber |
| 5,951,406 | A | 9/1999 | Steane |
| 6,379,256 | B1 | 4/2002 | Gatto |
| 6,575,052 | B2 | 6/2003 | Toennesland et al. |

(Continued)

FOREIGN PATENT DOCUMENTS

| | | | |
|---|---|---|---|
| CN | 202920961 | U | 5/2013 |
| CN | 204017350 | U | 12/2014 |
| DE | 202008002060 | U1 | 4/2008 |

*Primary Examiner* — Kien T Nguyen
(74) *Attorney, Agent, or Firm* — Lando & Anastasi, LLP

(57) ABSTRACT

A mechanical advantage device includes a base, a beam pivotably connected to the base at a fulcrum between a first end of the beam and a second end of the beam, a seat at the first end of the beam, and a load at the second end of the beam. In some embodiments, the mechanical advantage device includes structure, such as a linkage, for effecting oscillation of the beam by shifting weight along the beam. The mechanical advantage device may be a single-person seesaw. In some embodiments, the mechanical advantage device may be used to move a car or to generate power.

19 Claims, 22 Drawing Sheets

(56) References Cited

U.S. PATENT DOCUMENTS

| | | | | |
|---|---|---|---|---|
| 6,872,145 | B1 | 3/2005 | Boudreaux et al. | |
| 6,899,631 | B1 | 5/2005 | Zuber | |
| 6,989,951 | B2 | 1/2006 | Lee et al. | |
| 7,118,514 | B2 | 10/2006 | Underbrink et al. | |
| 7,572,190 | B2 * | 8/2009 | Habing | A63G 11/00 482/130 |
| 7,993,208 | B2 | 8/2011 | Gordon | |
| 8,033,921 | B2 * | 10/2011 | Habing | A63G 13/08 472/113 |
| 8,100,776 | B2 | 1/2012 | Habing | |
| 9,415,317 | B2 | 8/2016 | Hatfield | |
| 9,623,341 | B1 | 4/2017 | Mamelka | |
| 2007/0044272 | A1 | 3/2007 | Misin | |
| 2007/0167245 | A1 | 7/2007 | Chacon et al. | |
| 2016/0089609 | A1 | 3/2016 | Hatfield | |

* cited by examiner

MECHANICAL ADVANTAGE DEVICE

CROSS-REFERENCE TO RELATED APPLICATIONS

This application is a divisional of U.S. patent application Ser. No. 18/425,658 titled "MECHANICAL ADVANTAGE DEVICE," filed Jan. 29, 2024, which is a continuation-in-part application of U.S. patent application Ser. No. 18/133,370 [U.S. Pat. No. 11,883,756] titled "MECHANICAL ADVANTAGE DEVICE," filed Apr. 11, 2023, which claims the benefit under 35 U.S.C. § 119(e) to U.S. Provisional Application Ser. No. 63/362,871 titled "MECHANICAL ADVANTAGE DEVICE," filed Apr. 12, 2022, each of which is incorporated by reference herein in its entirety for all purposes.

BACKGROUND OF THE DISCLOSURE

1. Field of the Disclosure

The present disclosure relates generally to a mechanical advantage device. In some embodiments, the mechanical advantage device is a selectively lockable linkage. In some embodiments, the selectively lockable linkage is incorporated into a seesaw. In some embodiments, the seesaw may be operated by a single user.

SUMMARY OF THE DISCLOSURE

One aspect of the present disclosure is directed to a single-person seesaw. In some embodiments, the seesaw comprises a base; a beam pivotably connected to the base at a fulcrum between a first end the beam and a second end of the beam; a seat at the first end of the beam; a load at the second end of the beam; a lock bar secured to the base; a lock arm having a first end pivotably connected to the beam near the second end of the beam and having a second end that is configured to engage the lock bar; a first link having a first end pivotably secured to the beam between the fulcrum and the first end of the beam and a second end that is free; and a cable having a first end connected to the first link near the first end of the link and having a second end connected to the second end of the lock arm, wherein rotation of the first link in a first direction pull the cable to cause the second end of the lock arm to disengage the lock bar and allow the load to rotate the beam such that the seat moves upwardly.

In some embodiments, the single-person seesaw comprises a second link; a third link; a first cross bar linking the first link to the second link; and a second cross bar linking the first link to the third link.

In some embodiments, the single-person seesaw further comprises a foot bar secured to the second end of the second link.

In some embodiments the load is dynamically adjustable.

In some embodiments, the load includes a bucket.

In some embodiments, the bucket includes a drain connected to the reservoir.

In some embodiments, the seesaw further includes a reservoir and a pump configured to deliver water from the reservoir to the bucket.

In some embodiments, the seesaw further comprises a toggle switch in communication with the pump to allow a user to turn the pump on or off.

In some embodiments, the seesaw further comprises a pair of movable wings that are rotatable by the linkage.

Another aspect of the present disclosure is directed to a single-person seesaw comprising a base; a beam pivotably connected to the base at a fulcrum between a first end of the beam and a second end of the beam; a seat at the first end of the beam; a load at the second end of the beam; and a means for effecting oscillation of the beam by shifting weight along the beam.

In some embodiments, the means for effecting oscillation includes a lock bar secured to the base; and a lock arm having a first end pivotably connected to the beam near the second end of the beam and having a second end that is configured to engage the lock bar.

In some embodiments, the means for effecting oscillation further includes a first link having a first end pivotably secured to the beam between the fulcrum and the first end of the beam and a second end that is free; and a cable having a first end connected to the first link near the first end of the link and having a second end connected to the second end of the lock arm, wherein rotation of the first link in a first direction pulls the cable to cause the second end of the lock arm to disengage the lock bar and to allow the load to rotate the beam such that the seat moves upwardly.

The present disclosure will be more fully understood after a review of the following figures, detailed description, and claims.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. Reference is made to the following drawing figures, which are incorporated herein by reference and in which.

DETAILED DESCRIPTION OF THE PREFERRED EMBODIMENTS

Figure 1:
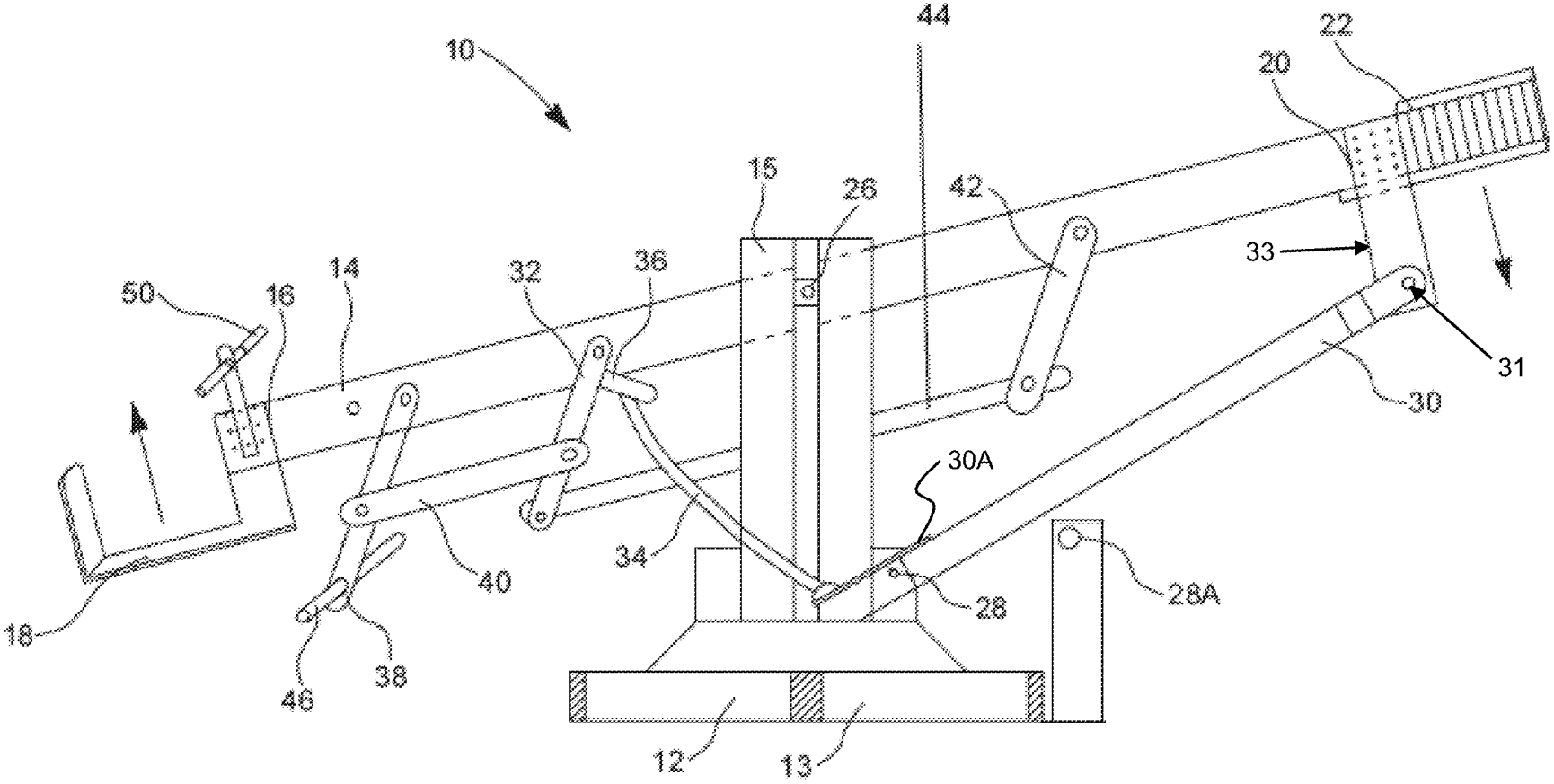
FIG. 1 is a schematic elevation view of an embodiment of a seesaw according to the present disclosure.

For the purposes of illustration only, and not to limit the generality, the present disclosure will now be described in detail with reference to the accompanying figures. This disclosure is not limited in its application to the details of construction and the arrangement of components set forth in the following description or illustrated in the drawings. The apparatus of embodiments disclosed herein is capable of other embodiments and of being practiced or being carried out in various ways. Also the phraseology and terminology used herein is for the purpose of description and should not be regarded as limiting. The use of "including," "comprising," "having," "containing" "involving," and variations thereof herein, is meant to encompass the items listed thereafter and equivalents thereof as well as additional items.

For purposes of illustration, embodiments of the present disclosure will now be described with reference to a single-person seesaw. The seesaw generally includes a base and a beam that is pivotable with respect to the base. A first end of the beam includes a seat for a rider. A second end of the beam includes a load to cause the seesaw to rotate to lift the rider when a locking mechanism of the seesaw is disengaged. The locking mechanism includes a lock beam, a lock bar, and at least one link that is rotatable by the rider to cause the lock beam to disengage a locking surface on the lock bar. In some embodiments, the load is sufficiently heavy to cause the beam to rotate from a first orientation to a second orientation, in which the beam stops rotating. In some embodiments, the weight of the load is selected to allow for rotation of the beam from the first orientation to the second orientation and then allow for some continued oscillation of the beam.

In some embodiments, the load at the second end of the beam may include a person. For example, a first person may be at the first end of the beam, and a second person may be at the second end of the beam. In some embodiments, the load at the second end of the beam may include the second rider and an object to add additional weight, as needed for proper operation of the device. In some embodiments, the load at the second end of the beam may be just the weight of the second person.

The required weight of the load at the second end of the beam is determined by balancing the moment (force times distance) of each component along the length of the beam. For example, the moment of the rider at the first end of the beam, the moment of the seat(s) at the first end of the beam, the moment of the load at the second end of the beam, and the moments of other components along the length of the beam balance out to zero or about zero when the seesaw is properly balanced.

The seesaw is configured to allow the rider to repetitively lift the load at the second end of the beam. This ability to repetitively lift the load is enabled by the rider's (or riders') weight and actions.

The beam of the seesaw is held in near balance between the rider and the load. This balance can be easily influenced or manipulated. In exemplary embodiments, the rider's full weight is greater than a weight of the load by less than five pounds. The load may be pre-adjusted based on the rider's specific weight before the rider mounts the seesaw. Any weight variation added or removed from the load, must be countered (in some fashion) on the opposite end to ensure near balance operation of the seesaw.

The seesaw may be configured in a variety of shapes. For example, the seesaw may have the appearance of a bird, so it appears that the single rider is riding a bird. Other shapes may be selected, based on user preferences.

Turning now to FIG. 1, an exemplary embodiment of a single rider seesaw is indicated generally at 10. The single rider seesaw 10 includes a base 12 and a beam 14 that is rotatable with respect to the base. A first end 16 of the beam includes a seat 18 for a rider. A second end 20 of the beam includes a load 22. The beam of the seesaw 10 is held in the orientation shown in FIG. 1 by the weight of the load 22 being pulled down by gravity and by a lock arm 30 that opposes rotation of the beam 14 due to the weight of the load 22. Operation of the seesaw 10 will be discussed in further detail below.

The base 12 is configured to be supported on a surface. In some embodiments, the base 12 is configured to be supported on an outdoor ground surface. In some embodiments, the base 12 is configured to be supported on an indoor floor surface. In FIG. 1, the base 12 includes a lower portion 13 with a horizontal lower surface. The base 12 of FIG. 1 includes a vertically extending portion 15 with an upper end that is configured to connect to the beam 14 so the beam may rotate with respect to the base 12.

In some embodiments, the lower portion 13 and the vertically extending portion 15 are not integrally formed. In some embodiments, the lower portion 13 and the vertically extending portion 15 are integrally formed.

The beam 14 has a length measured from the first end 16 of the beam and the second end 20 of the beam. In some embodiments, the length of the beam 14 is 14 feet.

The beam 14 is pivotably connected to the base 12 at the fulcrum point 26, and the beam 14 is configured to rotate about the fulcrum point 26. The fulcrum point 26 is located between the first end 16 of the beam and the second end 20 of the beam 14.

In some embodiments, the fulcrum point 26 is centered with respect to the length of the beam 14. In embodiments in which the fulcrum point 26 is centered with respect to the length of the beam 14, the mechanical advantage of the seesaw 10 is derived from movements of various elements of the seesaw 10.

In some embodiments, a mechanical advantage system includes the seesaw 10 and at least one other lever machine or mechanical advantage device that may be used to provide an additional mechanical advantage of the mechanical advantage system. In some embodiments, the mechanical advantage system includes the seesaw 10 and at least one additional seesaw, which may be constructed the same as the seesaw 10. In some such embodiments, the seesaw 10 and the additional seesaw(s) each contribute to the total mechanical advantage of the mechanical advantage system. In some embodiments of the mechanical advantage system, the seesaw and the additional seesaw(s) are connected in series.

In some embodiments, the seat 18 is configured to support at least one rider. In some embodiments, the seat 18 is configured to support more than one rider. In some embodiments, the seat 18 includes a safety belt, which is configured to selectively secure a rider to the seat.

The seat 18 may include an ergonomic seat base and seat back to comfortably support the rider(s).

In some embodiments, the weight of the load 22 may be a static weight, which has a fixed value. In some embodiments, the weight of the load 22 may be a dynamic weight, which has a changeable value.

For either static or dynamic loads, the weight of the load 22 is selected to cause a desired performance of the seesaw 10.

Figure 6:
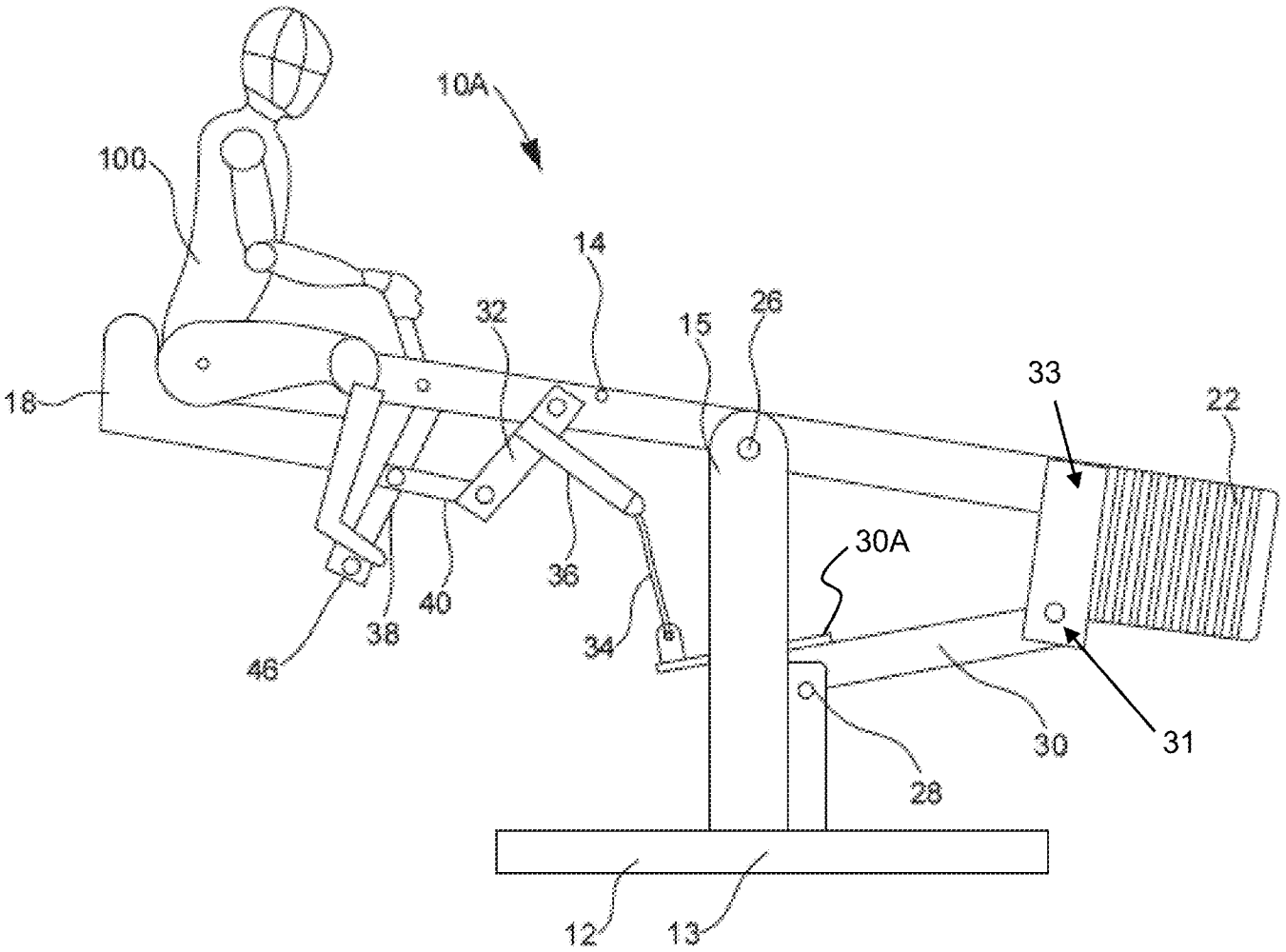
Figure 7:
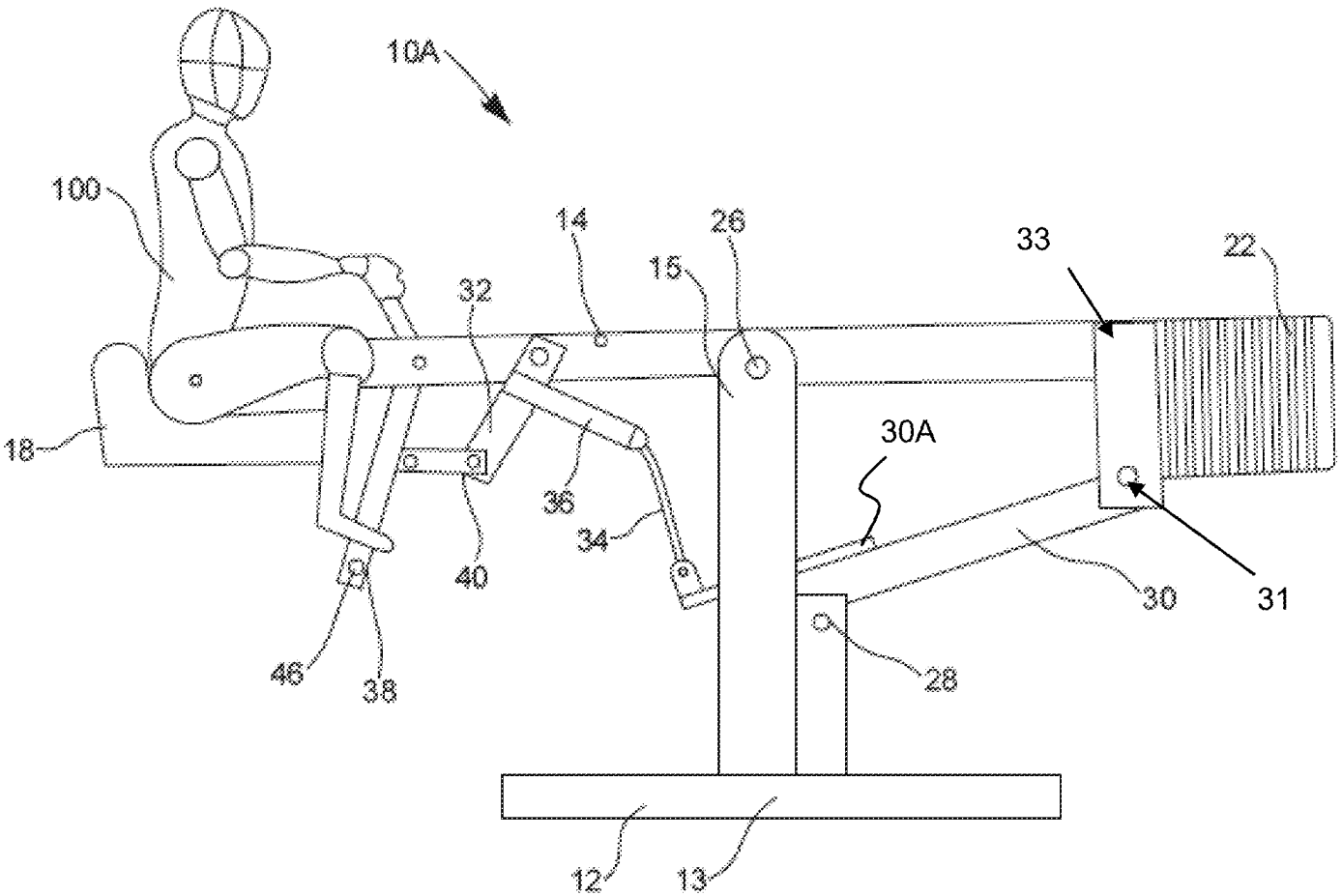

The desired performance of the seesaw 10 is to complete a full cycle of rotation from the orientation shown in FIG. 1 to the orientation shown in FIG. 6 and to return to the orientation shown in FIG. 1 repetitiously, as the rider has the option of repeating the full cycle.

The seesaw 10 includes a locking mechanism so the orientation of the beam of the seesaw 10 is selectively lockable in the orientation shown in FIG. 1. When the locking mechanism is engaged, the beam 14 is held in the orientation of FIG. 1. When the locking mechanism is disengaged, the beam 14 is free to move to another orientation.

In the embodiment of FIG. 1, the locking mechanism includes a lock bar 28 that is secured to the base 12 and a lock arm 30 that is connected at a first end to the beam 14 near the second end 20 of the beam 14 using a lock arm support 33. The lock arm support 33 houses the lock arm pivot 31 in various locations. The placement of the lock arm pivot 31 on the lock arm support 33 secures the position of the lock arm 30 on the load end of the beam 14. The lock arm 30 has a second end that is configured to engage the lock bar 28. In some embodiments, the engagement between the lock arm 30 and the lock bar 28 is frictional engagement. In some embodiments, the lock arm 30 includes a recess on its second end to receive the lock bar 28. The second end of the lock arm 30 includes a lock arm extension 30A connected to cable 34. The lock arm extension 30A may have adjustable lengths for the requirements of different embodiments.

In some embodiments, the seesaw includes a return assist bar (a second bar) 28A mounted on the base within close proximity to the first lock bar. This return assist bar provides an optional resting point for the lock arm to drop to, when the rider ceases pressure to the foot bar. This return assist bar allows for an even faster return of the beam 14 to the orientation shown in FIG. 1, compared to the time it would take the beam 14 to return from the lock bar as shown in FIG. 1. In some embodiments, the base 12 includes a second bar mechanism that includes a return assist bar, which may be located at 28A.

In some embodiments, the lock arm 30 further includes one or more additional features such as a latch to secure the lock arm 30 to the lock bar 28.

The locking mechanism may be disengaged by lifting the lock arm 30 with respect to the lock bar 28. When a rider is seated in the seesaw 10, the rider may disengage the lock arm 30 from the lock bar 28 by operating a linkage, which is included in the seesaw 10 of FIG. 1.

The linkage of the seesaw 10 of FIG. 1 includes a first link 32 having a first end that is pivotably secured to the beam 14 between the fulcrum 26 and the first end 16 of the beam 14. The first link 32 has a second end that is free. In some embodiments, the cable 34 has a first end connected to an arm 36 of the first link 32 that is located near the first end of the first link 32 and that extends perpendicularly from the main axis of the first link 32. The cable 34 has a second end connected to the second end of the lock arm 30 at lock arm extension 30A. When the seesaw 10 is in the orientation shown in FIG. 1, the cable 34 is held in tension. This tension is adjusted in the preparation stage and is actually used to force the foot bar linkage toward the rider for easier access and operation. This tension loads energy to the foot bar enabling an instantaneous response from the lock arm.

Rotation of the first link 32 in a first direction pulls the cable 34 to cause the second end of the lock arm 30 to disengage the lock bar 28 and to allow the load 22 to rotate the beam 14 such that the seat 18 moves upwardly.

According to at least one embodiment, to provide further stability and to improve performance of the seesaw 10, the linkage can include a second link 38 that is connected to the first link 32 by a first cross bar 40 and a third link 42 that is connected to the first link 32 by a second cross bar 44.

The second link 38 has a first end that is pivotably secured to the beam 14 between the first end 16 of the beam 14 and the location at which the first link 32 is secured to the beam 14. The first cross bar 40 has a first end that is secured to a middle portion of the second link 38 and a second end that is secured to a middle portion of the first link 32. The second end of the second link 38 further includes a foot bar 46. The rider may push against the foot bar 46 to cause the second link 38 to rotate, and thus cause the first link 32 to rotate to pull the cable 34, to disengage the lock arm 30 from the lock bar 28.

The third link 42 has a first end that is pivotably secured to the beam 14 between the second end 20 of the beam 14 and the location at which the first link 32 is secured to the beam 14. The second cross bar 44 has a first end that is secured to the second end of the first link 32 and a second end that is secured to a second end of the third link 42.

The three links 32, 38, 42 are free to rotate as pendulums. The swinging motion of the three links 32, 38, 42 in unison helps to keep the beam 14 oscillating for a period of time from an orientation in which the seat is at a height that is above a height of the load to an orientation in which the seat is at a height that is below the height of the load. The beam will continue to oscillate as long as the rider continues to apply periodic pressure to the foot bar. Failure to apply the repeated pressure to the foot bar will result in the beam returning to the orientation shown in FIG. 1. As long as the links 32, 38, 42 are kept in proper motion, there will be oscillation of the beam 14 of the seesaw 10. When the force applied to the foot bar ceases, the rider will return to their initial position shown in FIG. 1.

The motion of the seesaw 10 can be intuitive to riders who are familiar with using a swing, with back-and-forth timing. The rider sits in the seat 18, holds handles 50 securely, and places their feet on the foot bar 46.

The function of hand operation requires the rider to pull back the handles 50 of the assembly toward the rider with a minimal or maximized force, as desired, and then allow the handle to return to be pulled back again. Hand operation may function by incorporating the handle onto the foot bar linkage assembly, or function independently to power and control similar linkage assemblies along the full length of the beam.

In some embodiments, the seesaw 10 may be configured to oscillate in response to the rider moving the foot bar a distance of between approximately 5 inches and 9 inches. By limiting the length of the rider's leg stroke, it is easier for the rider to reach the maximum point of the leg stroke when moving the foot bar, and if the rider's leg is fully extended, the rider may be naturally inclined to take a standing position on the foot bar. The rider standing on the foot bar would be counterproductive to the goal of continued oscillation of the beam 14 of the seesaw 10.

In some embodiments, the seesaw 10 is specifically foot-driven, as opposed to hand-operated. In some embodiments, the seesaw may instead be hand-operated. Such hand-operated embodiments of the seesaw may be used by riders of different physical abilities or physical limitations. For example, a hand-operated embodiment of the seesaw may be used by a rider with limited or no use of their legs.

When the rider pushes the foot bar 46 a short distance (which may be, for example, between approximately 5 inches and approximately 9 inches in some embodiments), and with adequate (minimal) force, the lock arm 30 will raise, via the cable 34, and the rider rises. This is because the lock arm 30 disengaged from the lock bar 28, and the weight of the lock arm is now shared between the lift cable and the lock arm pivot.

It is at this point that the rider will have control of the motion of the machine.

As long as the rider applies a continuous pressure to the foot bar, the rider will reach the maximum height allowed (approximately at the 9:30 position (halfway between the 9 o'clock and 10 o'clock positions on a clockface if it were superposed over the beam when the beam is viewed from the side), and will remain in that position, until the rider ceases to apply pressure to the foot bar, at which point the rider will be returning to its original position.

Additionally, in some embodiments if the rider wishes to achieve rapid oscillation of the beam, when the rider removes the pressure from the foot bar, the removal of the pressure should be done with a rapid action, and a total cease of pressure, not just a slow reduction. Slow removal of pressure from the foot bar would be similar to dragging a user's feet on the ground as the users rides a swing.

When the rider ceases to apply pressure to the foot bar, and removes the pressure from the foot bar in a swift and rapid way, the weight of the lock arm gets dropped onto the lock bar. Important dynamics of the weight transfer occurs at this time. The weight was previously shared between the lift cable and the pivot of the lock arm. Instead, the weight is now shared between the pivot of the lock arm, and the resting point of the lock arm upon the lock bar. The lock bar now assumes a significant share of the lock arm weight, resulting in an increase in the return speed of the load, rising upward to its original position.

The present configuration assumes an expected amount of (minimal) friction between the lock arm, and the lock bar. The lock bar may be in a fixed/static position, or may be free to rotate within the securing points to the base. There are various options available to reduce this friction. One such embodiment mounts onto the lock bar, to accommodate the sliding lock arm across the lock bar to reduce friction, and the noise associated with the friction.

As the rider removes the pressure applied to the foot bar 46, the lock arm 30 lowers to rest on the lock bar 28 and drags across the lock bar 28 (as the load end of the beam rises) until either (1) the lock arm 30 drops into the locked position against the lock bar 28, or (2) the rider returns pressure to the foot bar 46 to continue oscillating movement of the seesaw 10.

To ensure safety during operation of the seesaw 10, the rider must always ensure that the lock arm 30 is securely engaged on the lock bar 28 before attempting to dismount the seesaw 10. In some embodiments, there may be additional locking mechanisms available to the rider to secure the beam 14 in the orientation shown in FIG. 1.

The operation gives the rider total control over how fast, and how high the machine functions, and the repetition is what forces the machine's continuous rocking motion.

Any position-shifting movements of the rider become mechanical advantage enhancers, including (1) mechanical advantage with leg movement and leg weight displacement during operation and (2) any suspended/pivoting physical pendulums, with or without additional weight. There are other mechanical advantage enhancers not mentioned here, but within the scope of the present disclosure, that either increase the power output, or reduce the power input required.

By shifting weight along the beam as described herein, a user may effect oscillation of the beam of the seesaw.

FIGS. 2-7 are sequential views of operation of an embodiment of a seesaw 10A according to the present disclosure. The seesaw 10A includes similar elements as the seesaw 10 described above. Like feature numbers in the figures showing the seesaw 10A correspond to like components from the seesaw 10.

Figure 2:
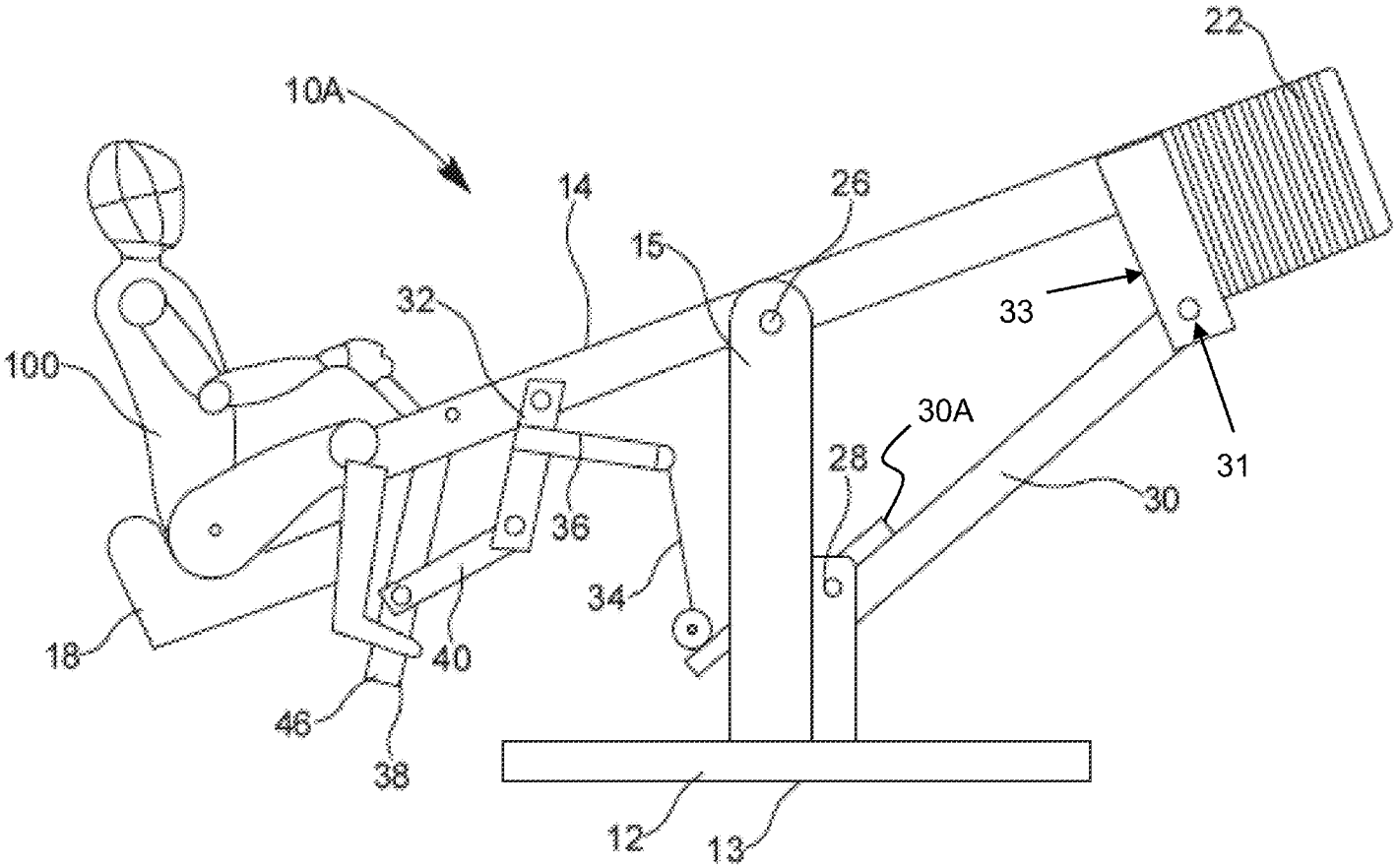
FIGS. 2-7 are sequential views of operation of an embodiment of a seesaw according to the present disclosure.
Figure 3:
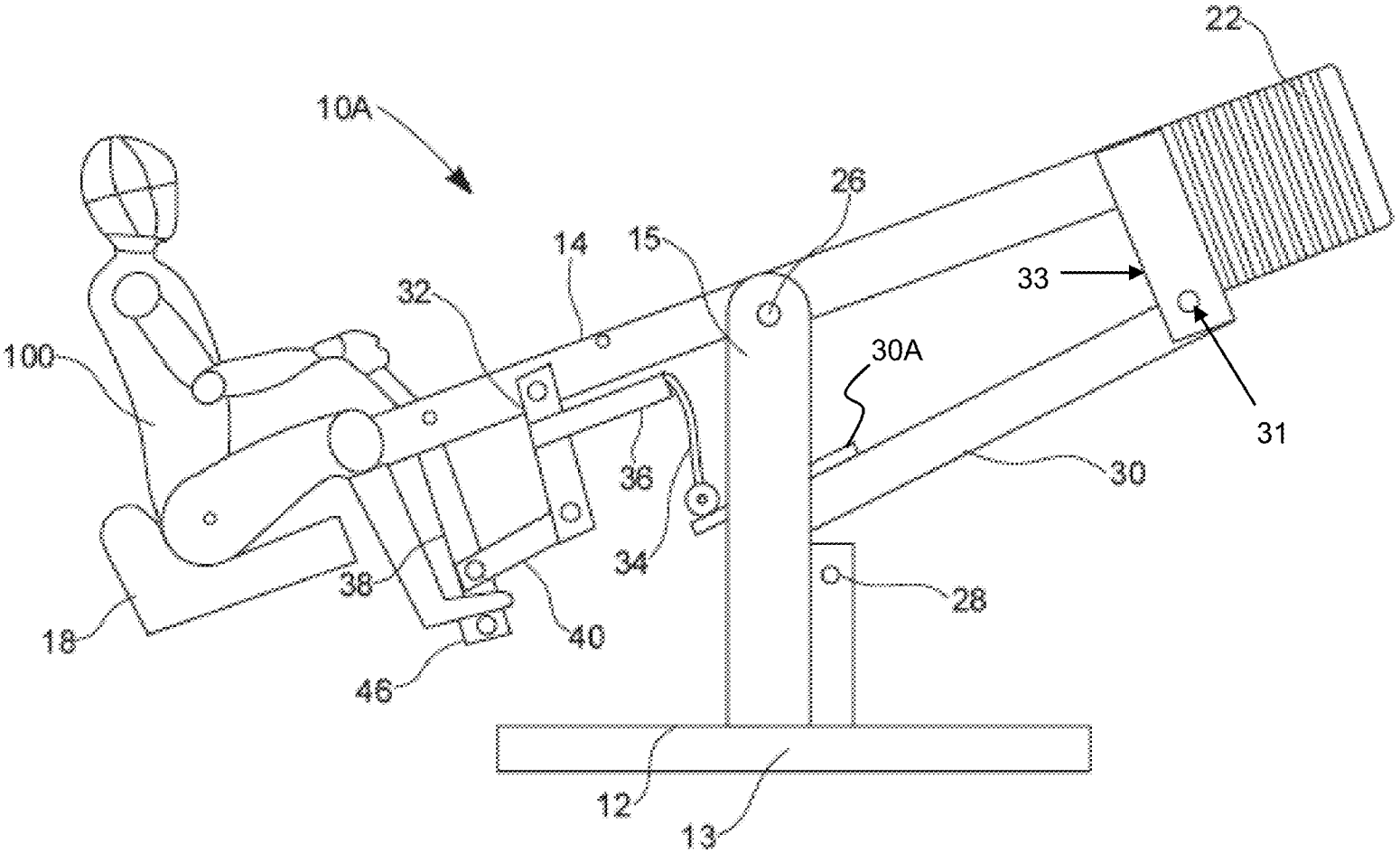
Figure 4:
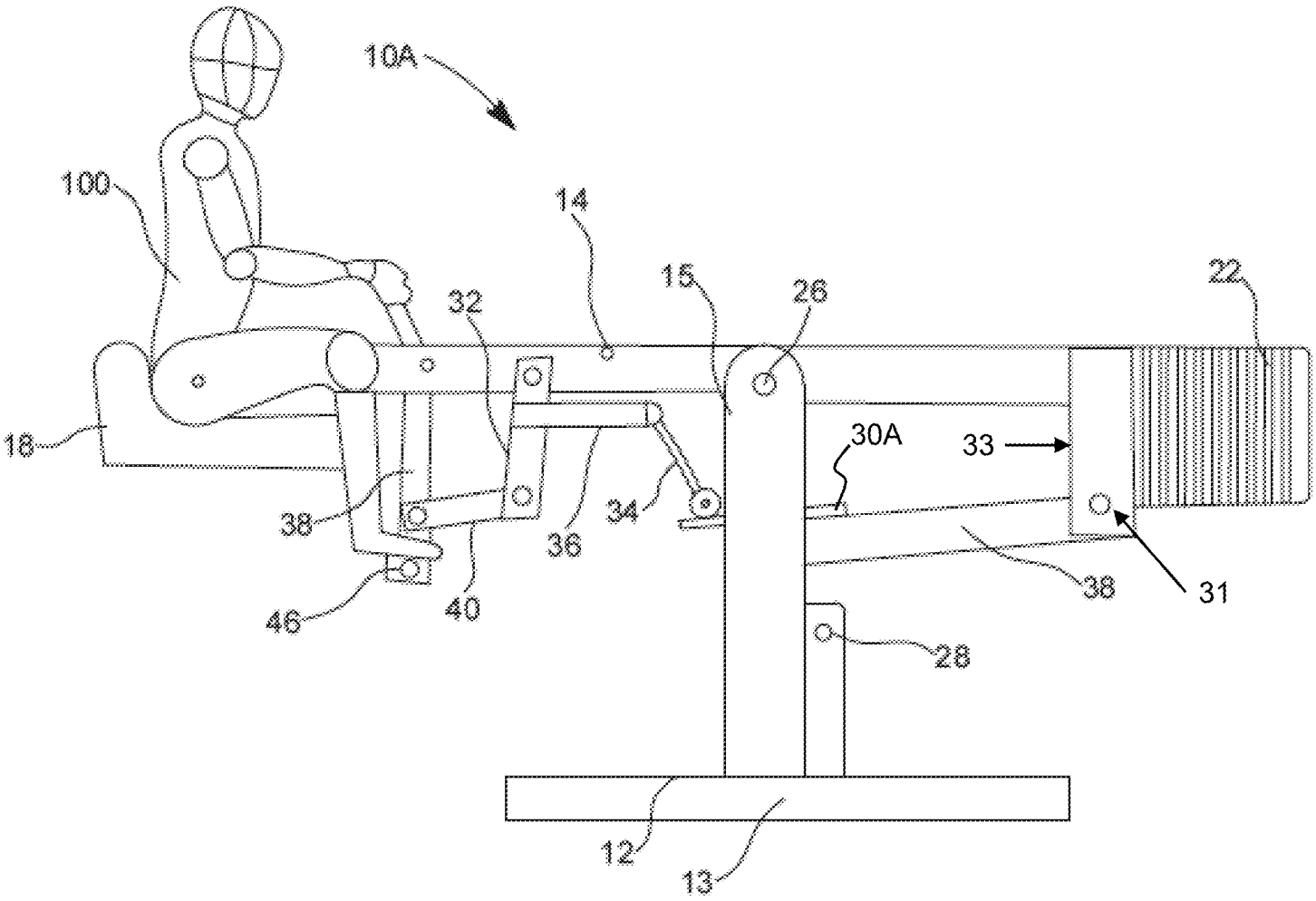
Figure 5A:
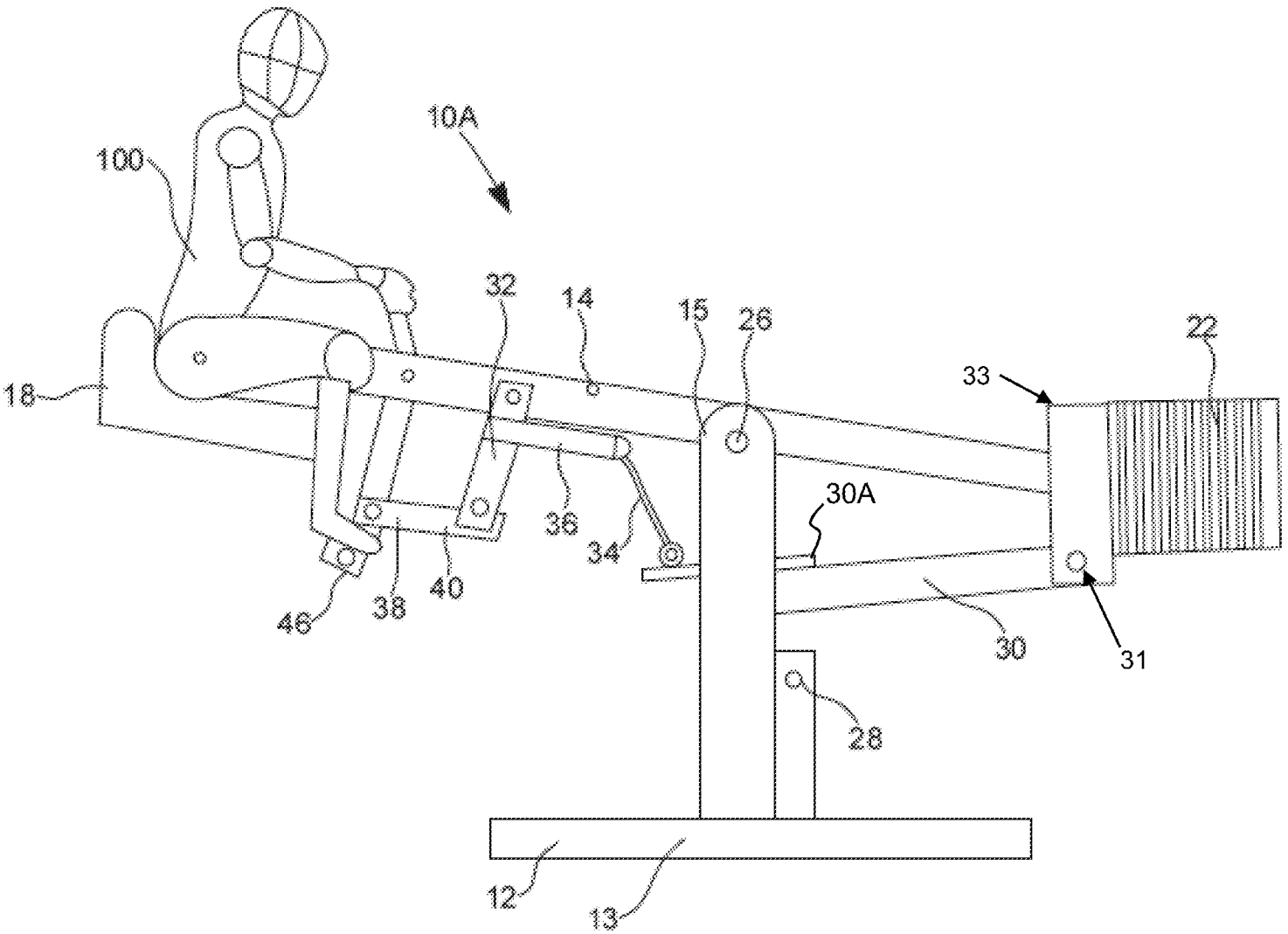
Figure 5B:
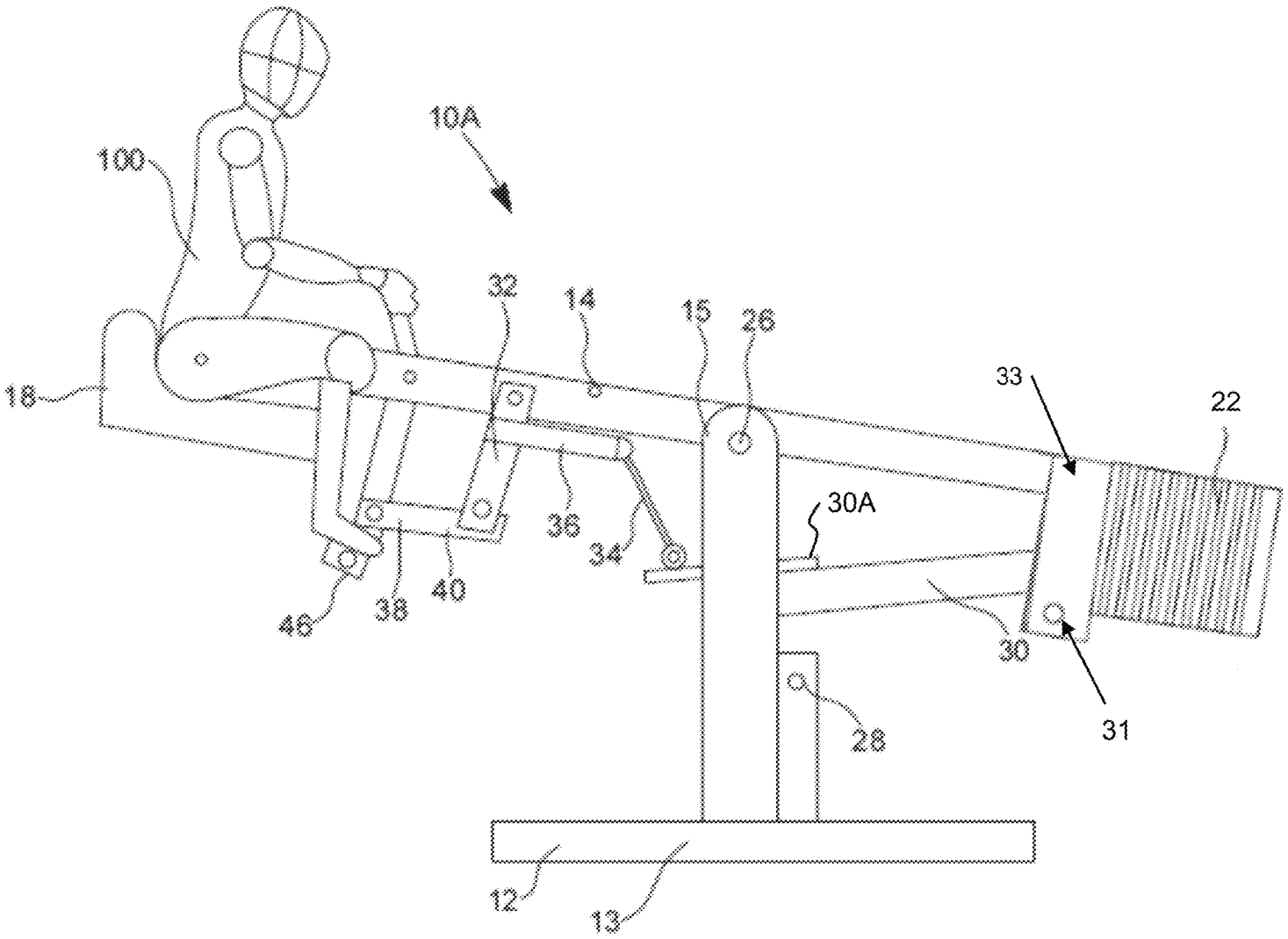
Figure 8:
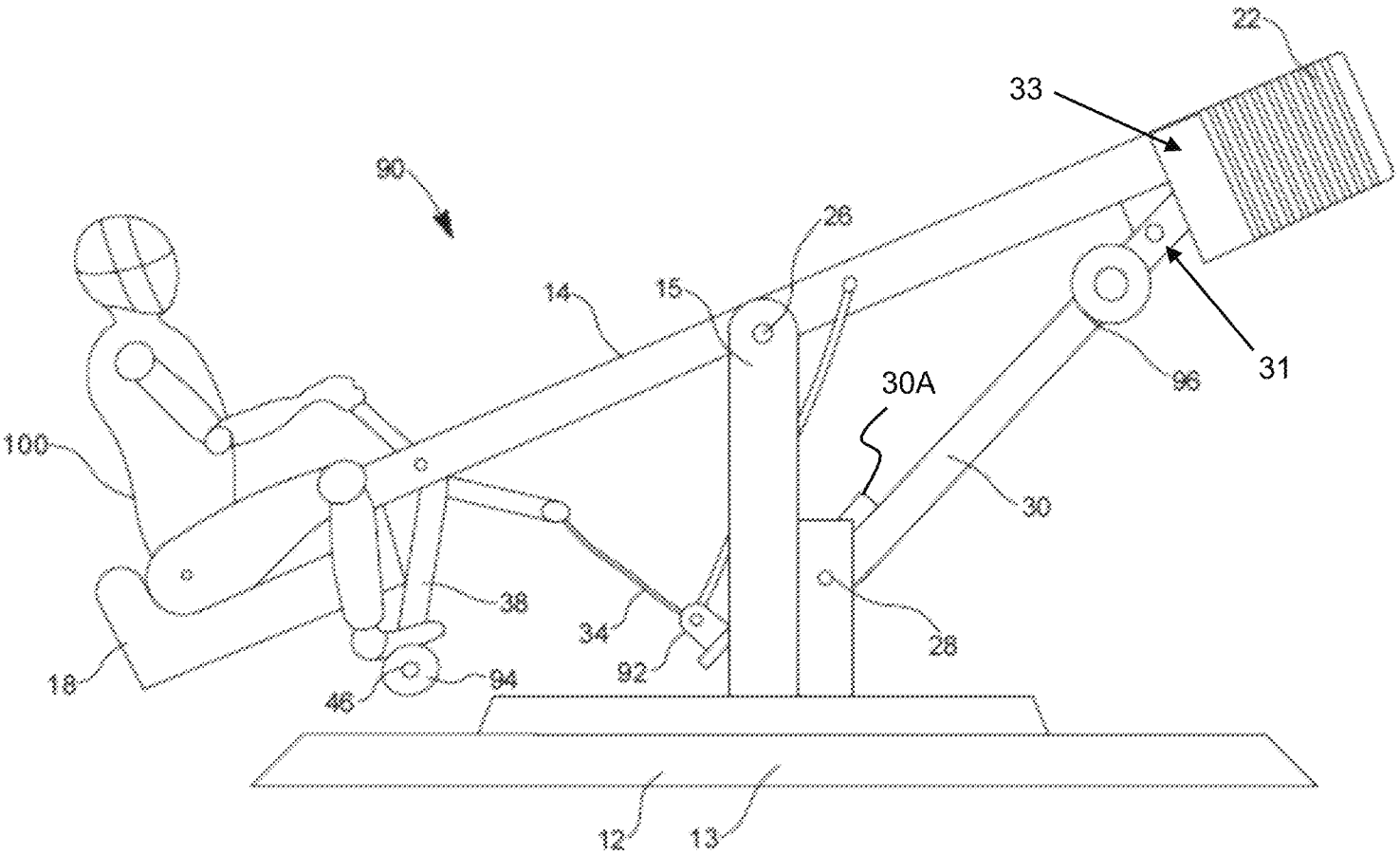
FIG. 8 is a schematic elevation view of another embodiment of a seesaw according to the present disclosure.

The linkage of the seesaw 10A of FIG. 2 includes a first link 32 having a first end that is pivotably secured to the beam 14 between the fulcrum 26 and the first end of the beam 14. The first link 32 has a second end that is free. A cable 34 has a first end connected to an arm 36 of the first link 32 that is located near the first end of the first link 32 and that extends perpendicularly from the main axis of the first link 32. The cable 34 has a second end that extends through the pulley 92 that is mounted on the free end of the lock arm 30, i.e., the lock arm extension 30A, as shown in FIG. 8, and the second end of the cable 34 may be mounted or secured to the beam 14 in various locations along the beam 14 as shown in FIG. 8. Rotation of the first link 32 in a first direction pulls the cable 34 to cause the second end of the lock arm 30 to disengage the lock bar 28 and to allow the load 22 to rotate the beam 14 such that the seat 18 moves upwardly.

To provide further stability and to improve performance of the seesaw 10, the linkage includes a second link 38 that is connected to the first link 32 by a first cross bar 40.

The second link 38 has a first end that is pivotably secured to the beam 14 between the first 16 of the beam 14 and the location at which the first link 32 is secured to the beam 14. The first cross bar 40 has a first end that is secured to a lower portion of the second link 38 and a second end that is secured to a lower portion of the first link 32. The lower the cross bar 40 is mounted on the second link 34, the longer distance traveled, resulting in a beneficial increase in the weight being transferred with respect to the beam 14. The second end of the second link 38 further includes a foot bar 46. The rider may push against the foot bar 46 to cause the second link 38 to rotate, and thus cause the first link 32 to rotate to pull the cable 34, to disengage the lock arm 30 from the lock bar 28.

In some embodiments, the seesaw 10, 10A may include one or more control systems. For example, the seesaw 10, 10A may include a control system to adjust the weight of the load 22. In some embodiments, the control system to adjust the weight of the load 22 includes a fluid system for adding fluid to or removing fluid from a tank of the load.

In some embodiments, two riders may drive the suspended linkage for improved oscillation. In some embodiments, a first rider drives the suspended linkage and the second rider is used as a load weight for balancing the seesaw. The second rider may be facing towards or away from the fulcrum.

FIG. 8 is a schematic view of another embodiment of a single rider seesaw of the present disclosure, generally indicated at 90. The seesaw 90 includes similar features as other embodiments, with like feature numbers indicating like features. For example, the single rider seesaw 90 includes a base 12 and a beam 14 that is rotatable with respect to the base. A first end of the beam includes a seat 18 for a rider 100. A second end of the beam includes a load 22. The beam of the seesaw 90 is held in the orientation shown in FIG. 8 by the weight of the load 22 being pulled down by gravity and by a lock arm 30 that engages lock bar 28 to oppose rotation of the beam 14 due to the weight of the load 22.

The base 12 of the seesaw includes a horizontal portion 13 and a vertical portion 15. The horizontal portion 13 of the base has a greater length relative to the horizontal base shown in other embodiments. The greater length of the horizontal portion of the base can improve the stability of the seesaw 90 relative to embodiments in which the horizontal portion of the base is shorter in length. In some embodiments, the load 22 may be positioned closer to the fulcrum 26 than that shown in FIG. 1, reducing the need for an extended horizontal portion of the base 13. When no rider is seated on the seesaw and when the counterweight 22 of the seesaw is supported by the lock arm 30 which is in engagement with the lock bar 28, the seesaw is relatively top heavy, and the base may be easily tipped if the footprint of the base is not large enough.

At the rider's end of the beam 14, additional weight may be added to increase the mechanical advantage of the seesaw. In particular, additional weights may be added to the link. The weights 94 are shown secured to the link 38 at a location below the foot bar 46. The lower the placement of the weights on the link, the greater the mechanical advantage is.

The location of the lift cable 34 on the second link 38 provides improved efficiency relative to other embodiments because of the angle of the cable with respect to the pulley on the free end of the lock arm 30, i.e., on the lock arm extension 30A. The cable is secured to the beam and is secured to the second link 38, and a middle portion of the cable engages the pulley 92 that is secured to the lock arm extension 30A. The cable 34 runs through the pulley 92 mounted on the lock arm extension 30A and is securely mounted to the beam 14. In this configuration, the embodiment of the pulley in FIG. 8 provides for a 50% reduction in the rider's effort to lift the lock arm 30 compared to the configuration illustrated in FIG. 7.

In an effort to convert the lock arm weight from being a static weight to a variable weight, a rod is secured to or through the lock arm 28 closer to the pivot end of the lock arm. Additional weights 96 are mounted to the rod on the lock arm. This is done in coordination with changes to weight at the rider's end of the seesaw. In particular, the weight of the additional weights 96 may be based on the rider's weight to ensure a properly balanced configuration. For example, if a rider chooses to add 20 pounds of weight to the lock arm, they must calculate and adjust to the equivalent of 20 pounds of weight to the opposite end of the beam. This may be where the rider sits, or elsewhere on the beam 14, and in a manner that considers the distance of the opposing countering weight added to the lock arm. Alternatively, a rider could remove some static counterweights, and mount them on the lock arm. There are numerous possible weight configurations and combinations that may be applied as needed on the beam 14, on both sides of the fulcrum.

In some embodiments, a reservoir at the first end of the beam (such as a reservoir having a volume of one gallon) is placed upon the beam within the rider's reach, and the rider is able to add or remove fluid from the reservoir at the first end of the beam. This enables the rider to fine-tune the overall balance (by 8 lbs. if the gallon of fluid is water) between the rider and the load, by adding or removing fluid in the reservoir.

In some embodiments, the rider sits at a position that is the same distance from the fulcrum of the beam as the distance of the counterweight from the beam. In such embodiments, the seesaw may be configured to allow the rider to raise and lower the counterweight (in reference to the fulcrum), and depending on the weight distribution of the components (such as the Handle, the Footbar, and the Links) along the beam.

For a properly balanced configuration, the rider's weight is dominant relative to the counterweight, and the seesaw 90 is configured to return the rider to their default position, if no other action occurs. There is no appreciable damping in one period of movement from the rider being seated horizontally below the counterweight with the lock arm engaging the lock bar to the rider being horizontally above the counterweight and back to the rider being seated horizontally below the counterweight with the lock arm engaging the lock bar.

Note that the counterweights in FIG. 8 illustrate the preferred mounting configuration in which at least a portion of the counterweight is located horizontally below the fulcrum, as is the rider. This improves stability of the seesaw 90.

The components of the seesaw may be made of any suitable material. In some embodiments, the components of the seesaw are made of materials including wood, plastic, metal, and/or a combination of these materials.

Figure 9:
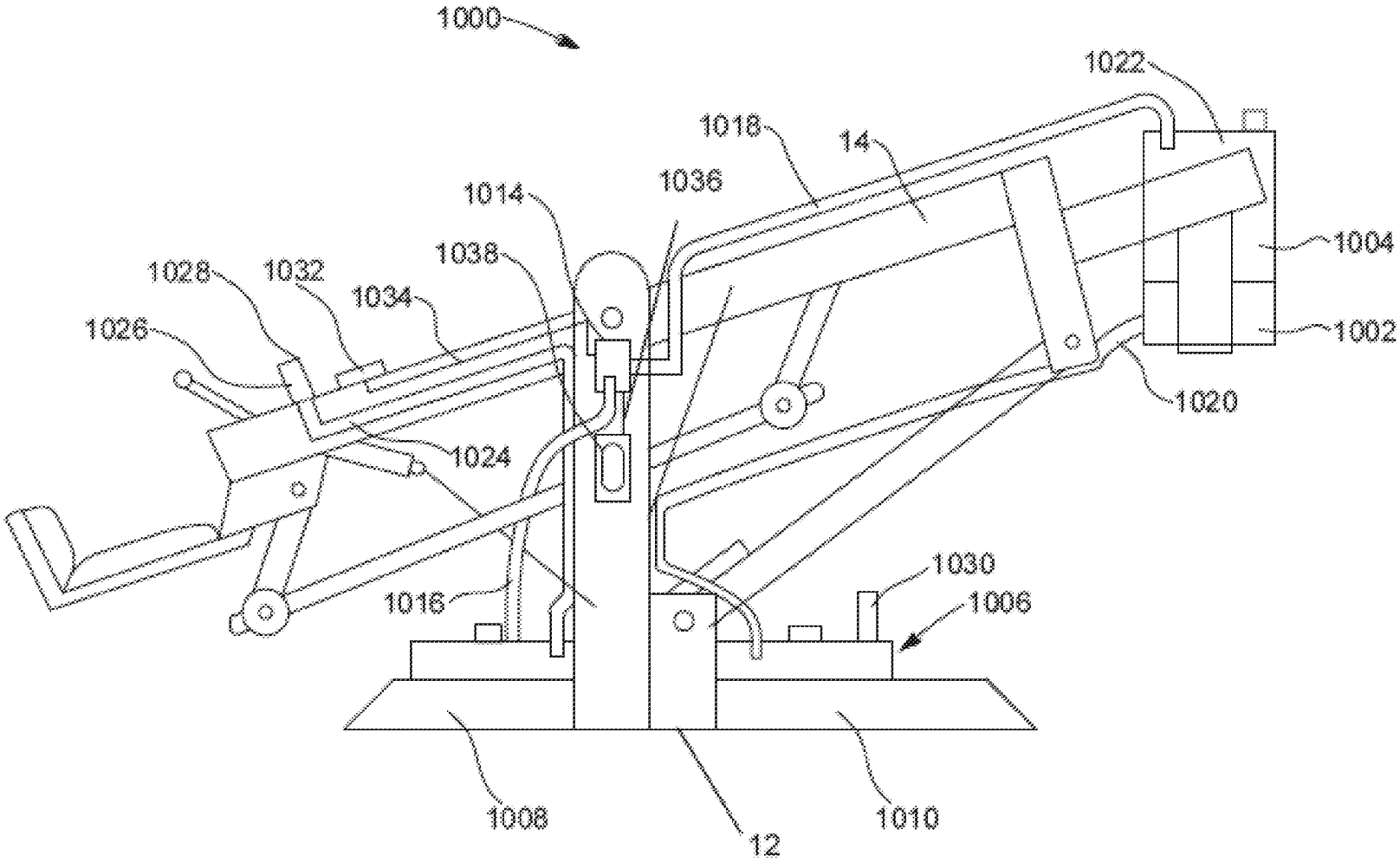
FIG. 9 is a schematic elevation view of another embodiment of a seesaw according to the present disclosure.

FIG. 9 is a view of another embodiment of seesaw, generally indicated at 1000, according to the present disclosure. The seesaw 1000 of FIG. 9 is similar to the seesaw 10 of FIG. 1, with like numbers indicating like features. However, in place of the counterweight 22 of the seesaw of FIG. 1, the seesaw of FIG. 9 includes a counterweight 1022 that includes a fluid 1002 secured to the counterweight end of the beam 14 and a system for adjusting the amount of fluid 1002 secured to the counterweight end of the beam 14.

To hold the fluid 1002, the system includes a drum 1004 located at the counterweight end of the beam 14. The drum 1004 is selectively fillable with fluid 1002 that may be provided from a reservoir subassembly 1006.

The reservoir subassembly 1006 includes a first tank 1008 and a second tank 1010. Fluid may be pumped from the first tank 1008 into the drum 1004. Fluid 1002 may be drained from the drum 1004 to the second tank 1010. A cross flow tube 1012 connects the second tank 1010 and the first tank 1008 so that fluid may flow between the second tank 1010 to the first tank 1008. In some embodiments, fluid may flow freely between the first tank and the second tank so that the fluid level is the same in the first tank as in the second tank.

The first tank 1008 is connected to a pump 1014 by a first fluid line 1016. A second fluid line 1018 connects the pump 1014 to the drum 1004. Operation of the pump is described further below.

A drain line 1020 connects the drum 1004 to the second tank 1010. Each fluid line may be secured by grommets at its respective ends.

To allow air to enter or exit the reservoir subassembly as fluid is added to or removed from the first tank and the second tank, one or more air lines may be included. In FIG. 9, an air line 1024 is connected to the second tank. The air line 1024 extends from the second tank 1010 to an air vent 1026. An air vent cap 1028 is selectively securable to the air vent 1026 when no movement of air through the air line 1024 is desired. An air connection valve 1030 is in communication with the air line 1024, allowing a user to selectively clear the system with an external air supply.

To allow a user to operate the pump 1014, an electrical system is connected to the pump 1014. The electrical system includes a toggle on/off switch 1032 that a user may control to selectively pump fluid from the first tank 1008 to the counterweight drum 1004. Pump wiring 1034 connects the toggle switch 1032 to the pump 1014. Wiring 1036 connects a power source, such as a battery, 1038 to the pump 1014.

Turning now to the operation of the pump 1014, a user may operate the pump 1014 to advance fluid 1002 from the first tank 1008 to the drum 1004. In some embodiments, the user may operate a drain on the drum 1004 to allow fluid 1002 to drain from the drum 1004 through the drain line 1020 to the second tank 1010. By operating the pump 1014 and/or drain, the user may adjust the amount of fluid 1002 in the drum 1004 to be a desired amount. The desired amount of fluid in the drum may be based on the weight of the rider at the end of the beam opposite the drum and/or the desired motion of the seesaw 1000. For example, to achieve a rocking movement of the beam 14 of the seesaw 1000, the weight of the fluid 1002 in the drum 1004 may be selected so the combined weight of the fluid 1002 and the drum 1004 is closely matched with the weight of the rider. As another example, to achieve a movement of the seesaw to move the rider to a high or low position, the combined weight of the drum 1004 and the fluid 1002 in the drum may be set to be substantially less than or substantially greater than the weight of the rider.

Figure 10:
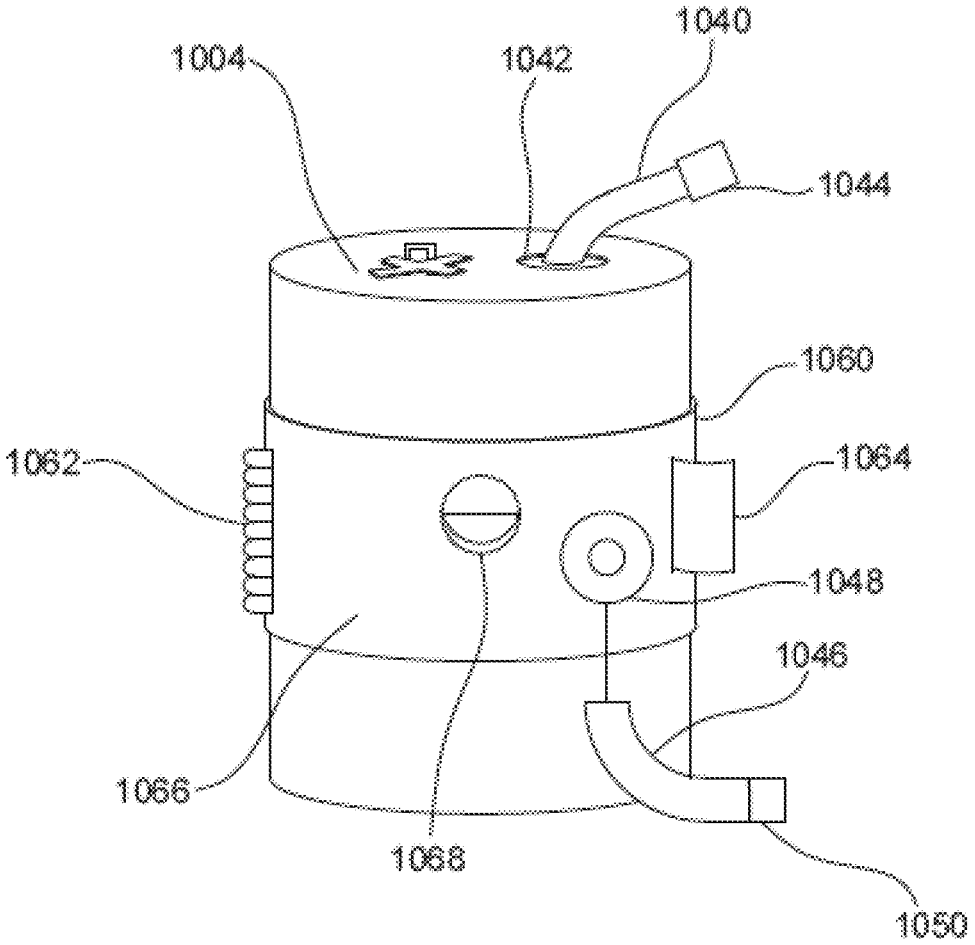
FIG. 10 is a schematic view of a drum usable in the seesaw of FIG. 9.

FIG. 10 shows an enlarged view of the drum. A first fluid port 1040 is secured to an upper end of the drum 1004 by grommets 1042. A cap 1044 is secured to an end of the first fluid port 1040. When the cap 1044 is removed, the first fluid port 1040 may be connected to the second fluid line 1018 to receive fluid from the pump 1014. A second fluid port 1046 is secured to a lower end of the drum 1004 by grommets 1048. A cap 1050 is secured to an end of the second fluid port 1046. When the cap 1050 is removed, the second fluid port 1046 may be secured to the drain line 1020 to allow fluid to drain from the drum 1004 to the second tank 1010 of the reservoir subassembly.

The drum 1004 is suspended from the counterweight end of the beam 14. As shown in FIG. 10, a clamp 1060 encircles the drum. The clamp 1060 includes a hinge 1062 and a locking latch 1064 connecting two c-shaped arms 1066. Each c-shaped arm 1066 includes two pivot posts 1068 configured to be mounted to the beam 14.

Figure 11:
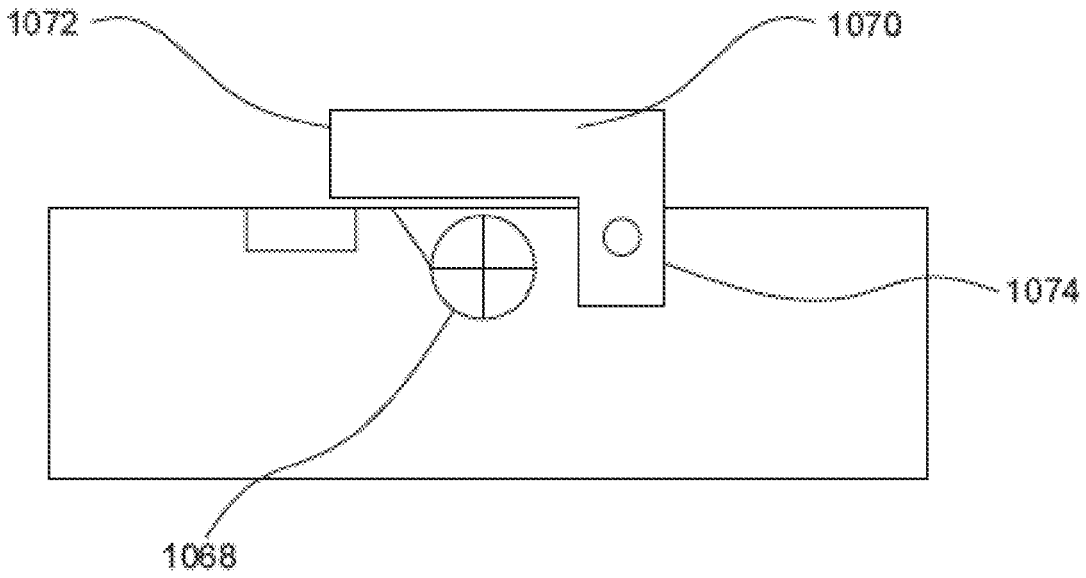
FIG. 11 is a schematic view of a lock plate for securing the drum of FIG. 10.

The beam includes two prongs, with the drum 1004 positioned between the two prongs. As shown in FIG. 11, each pivot post 1068 may be rotatably secured to a prong of the beam 14. To prevent the pivot post 1068 from moving translationally with respect to the beam 14, a lock plate 1070 is mounted on the beam 14. A hinge 1072 secures a first end of the lock plate 1070 to the beam 14. A lock pin 1074 selectively secures a second end of the lock plate 1070 to the beam 14. When the post 1068 is captured between the lock plate 1070 and the beam 14 and when the lock pin 1074 is secured, as shown in FIG. 11, the post 1068 may freely rotate with respect to the beam 14, and the drum 1004 is securely mounted on the beam 14 so it will not slide off of the beam 14 during oscillation of the seesaw.

Figure 12:
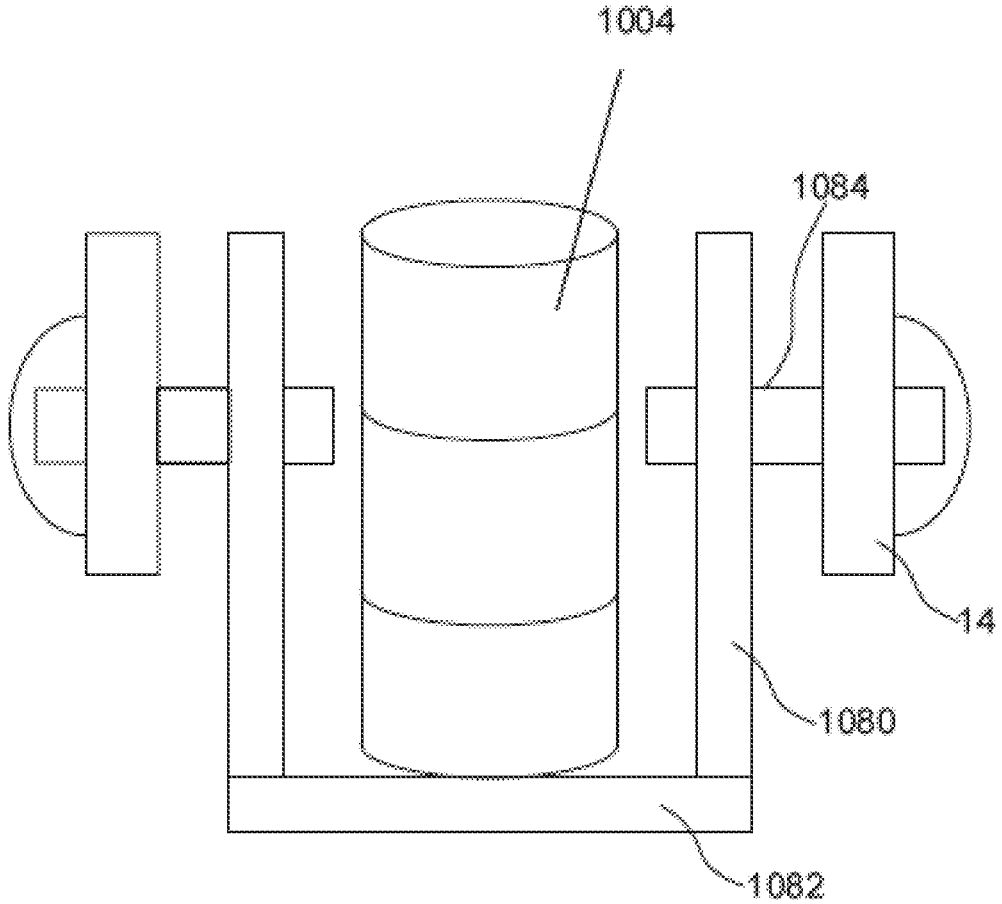
FIG. 12 is a schematic view of a support for the drum of FIG. 10.

It is further possible to support the drum 1004 in other structures that provide protection to the drum. For example, FIG. 12 shows a cradle 1080 for supporting the drum. The cradle includes a support surface 1082 on which the drum 1004 rests. The cradle includes posts 1084 that may be secured to the beam 14 by the lock plate 1070, in the same way as the post 1068 described above.

Figure 13:
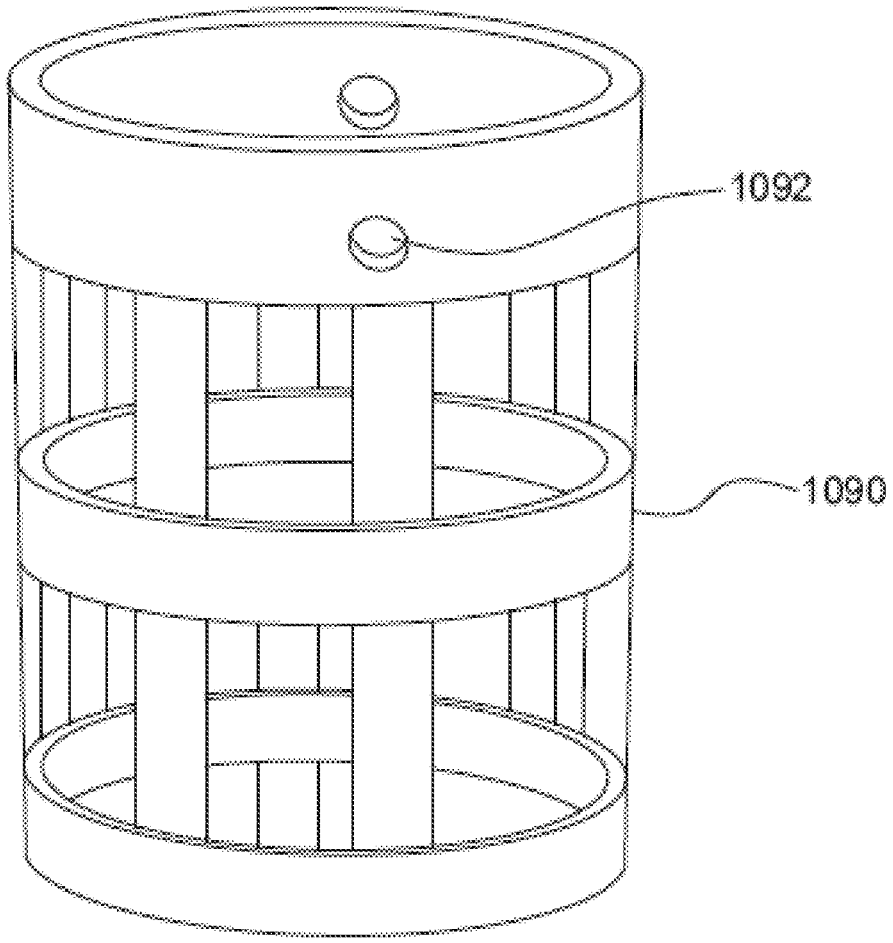
FIG. 13 is a perspective view of a basket for supporting a drum on a beam of the seesaw of FIG. 10.

As another example, FIG. 13 shows a basket 1090 defining an inner surface configured to support the drum 1004. The basket includes posts 1092 that may be secured to the beam 14 by the lock plate 1070, in the same way as the post 1068 described above.

In some embodiments, the seesaw is a simulative device that simulates movement of an animal, plant, or other thing. For example, in some embodiments, the seesaw simulates the movement of a bird. In some embodiments, the seesaw includes wings that simulate the movement of a bird's wings. In some embodiments, the wings are configured to function with very little effort when in near-balance. In some embodiments, a counterweight is required to achieve desired behavior of the wings. In various embodiments, the weight and the location of the wing counterweights are selected according to the weight required to counterbalance the weight of the wings, and the space required by the counterweights to function properly without interfering with the rotation of the wings or movement of other components of the mechanical advantage device.

Near-balance of the wings about a wing fulcrum can be achieved by adding weight to the counterweights or adjusting the position of the counterweights at the effort side of the wing (the root end of the wing) to counterbalance the opposing linear weight of the load side of the wing (the wing tip end of the wing). In some embodiments, the wing's linear length and linear weight distribution may be designed so the wing is as light as possible, thus reducing the need for excessive counterweight measures.

In some embodiments, the force that rotates the wings about the wing fulcrum may be provided by a linkage assembly. The effort by linkage for wing function, may be slower due to mechanisms and movement.

In other embodiments, the force that rotates the wings may be from a cable that pulls down on the root end of the wing directly. For example, a cable may be attached to the root end of the wing.

The force to rotate the wing about the wing fulcrum may also be achieved by lifting a counterweight that is suspended by a cable from the wing's root end, allowing an immediate sharp drop of the wing tip.

The pivot radius of the wing's fulcrum may provide additional benefits when countering the linear weight of the load side of the wing, noting that a larger radius may be more beneficial in an effort to counterbalance the wings.

In some embodiments, the wing assembly may have an additional fulcrum fashioned to further assist the counterbalance of the wing. This allows the wing's movement to be controlled by the effect of additional sources in conjunction with the wing's main fulcrum.

In some embodiments, the wings are mounted on the load side of the main beams 14A, 14B in an offset plane from the central axis of the seesaw in a near-balanced state. In some embodiments, the wings 1502A, 1502B are mounted on an elevated fulcrum.

The shorter end of each wing requires a weight-countering measure, to account for the wing's imbalance due to the linear weight of the opposite end of the plane with respect to the fulcrum about which the wing rotates.

The movement of the wings may be manipulated by various means. In some embodiments, a linkage system is powered by the force applied by a rider that transfers the force to the wings, forcing the wings to rise and lower.

In some embodiments, the movement of the wings are the result of the gravitational force dropping the load side from a first position to a second position. When the load side of the seesaw lowers, the linkage attached to the counterweight side of the wing(s) is limited in movement. This is because the opposite end of the linkage is secured to the mainframe, limiting the linkage to a desired range of motion.

In some embodiments, wings are provided in pairs and may be linked together in some form which proves beneficial by assuring symmetry, timing, and movement of the wings simultaneously.

In other embodiments, the wings may work independently and function by an independent linkage, but timing the independent wings to function simultaneously will require greater precision in an effort to align the separate linkages for symmetry.

In some embodiments the fulcrums for the wings may be supported by 1, 2, or more vertical uprights on the main beam's load end. In some such embodiments, the wings are 'aesthetic' wings.

The wings may be strategically positioned at various points along the main beam, depending on the desired effect and the linkage assembly required for the desired effect. Also, the higher the wing is mounted, the more impact of mechanical advantage of the wing on the mechanical advantage device. For example, if the wing is positioned on the load side of the main fulcrum, that side will benefit from the mechanical advantage as the main beam transitions from a first position to a second position. The mechanical advantage factor of the wing assembly will vary with the design of the wing assembly. Generally, the wings provide a mechanical advantage for the seesaw that varies as the wings rotate up or down between different orientations of the wings. For example, in a seesaw that is driven by a linkage controlled by a rider, a user causing the wings to rotate from a horizontal orientation to a raised orientation in which each wing tip is above the root end of the respective wing results in a moment on the beam that urges the load end of the beam downward and the rider end of the beam upward. Conversely, in such a seesaw, a user causing the wings to rotate from a horizontal orientation to a lowered orientation in which each wing tip is below the root end of the respective wing results in a moment on the beam that urges the load end of the beam upward and the rider end of the beam downward. When the linkage assembly incorporates a lever with a stationary fulcrum mounted on the base or an extension of the base, a user may apply torque to the foot bar of the linkage to influence the mechanical advantage of the seesaw.

The mounting position and height of the wing/lever support uprights on the main beam may vary, and the adjusted height of the wing's fulcrum will determine the maximum length allowed for the wings. Noting that if the wings are excessive in length they will hit the ground, as that end of the machine is at its lowest point in its 2nd position.

In some embodiments, the wings are secured to a beam such as beam 14 of the seesaw 10 of FIG. 1. In some embodiments, the beam 14 of seesaw 10 is replaced with a plurality of beams, and each wing is secured to one of the beams.

Figure 14:
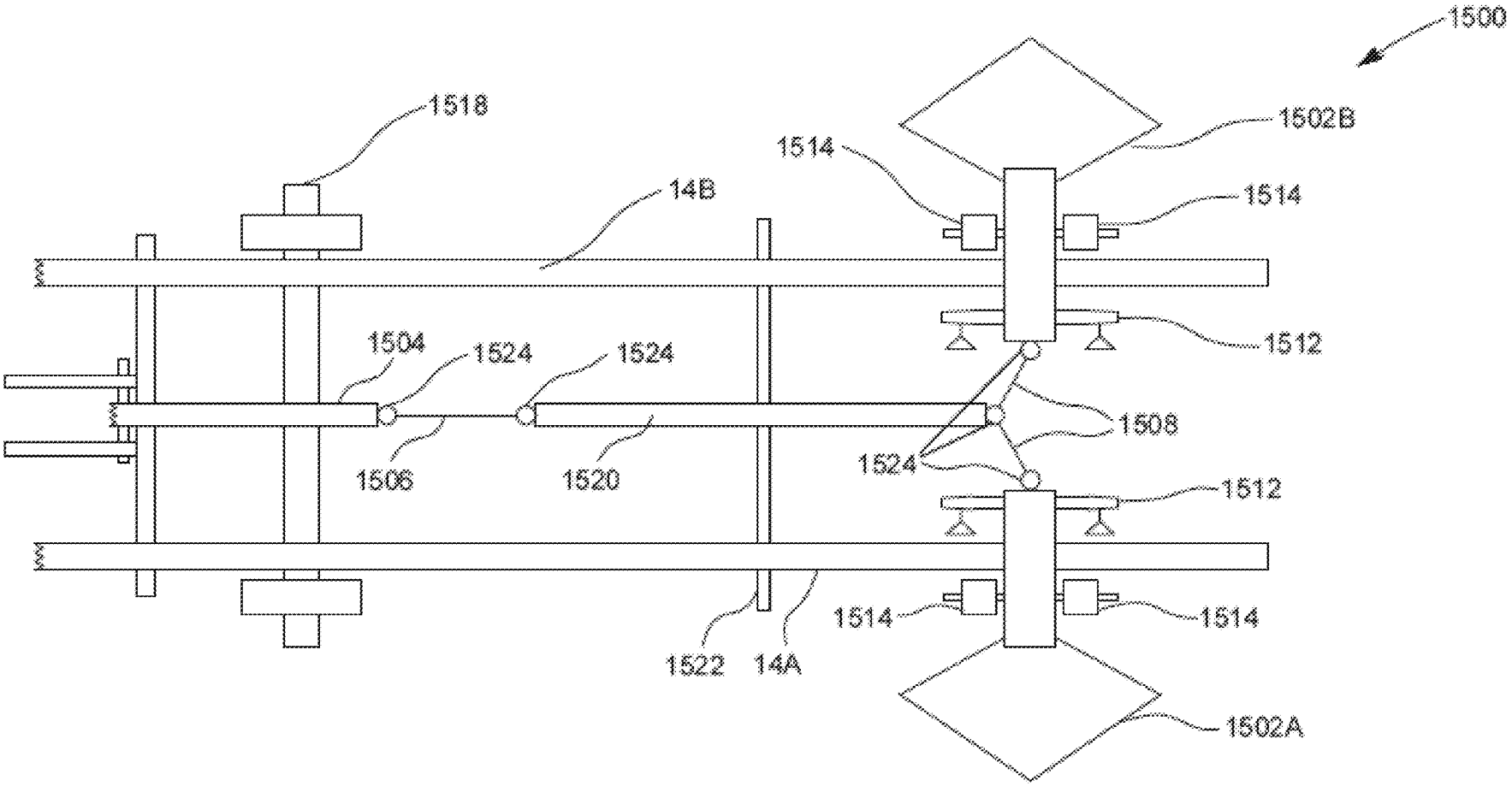
FIG. 14 is a top view of a portion an embodiment of a seesaw including a pair of movable wings.
Figure 15:
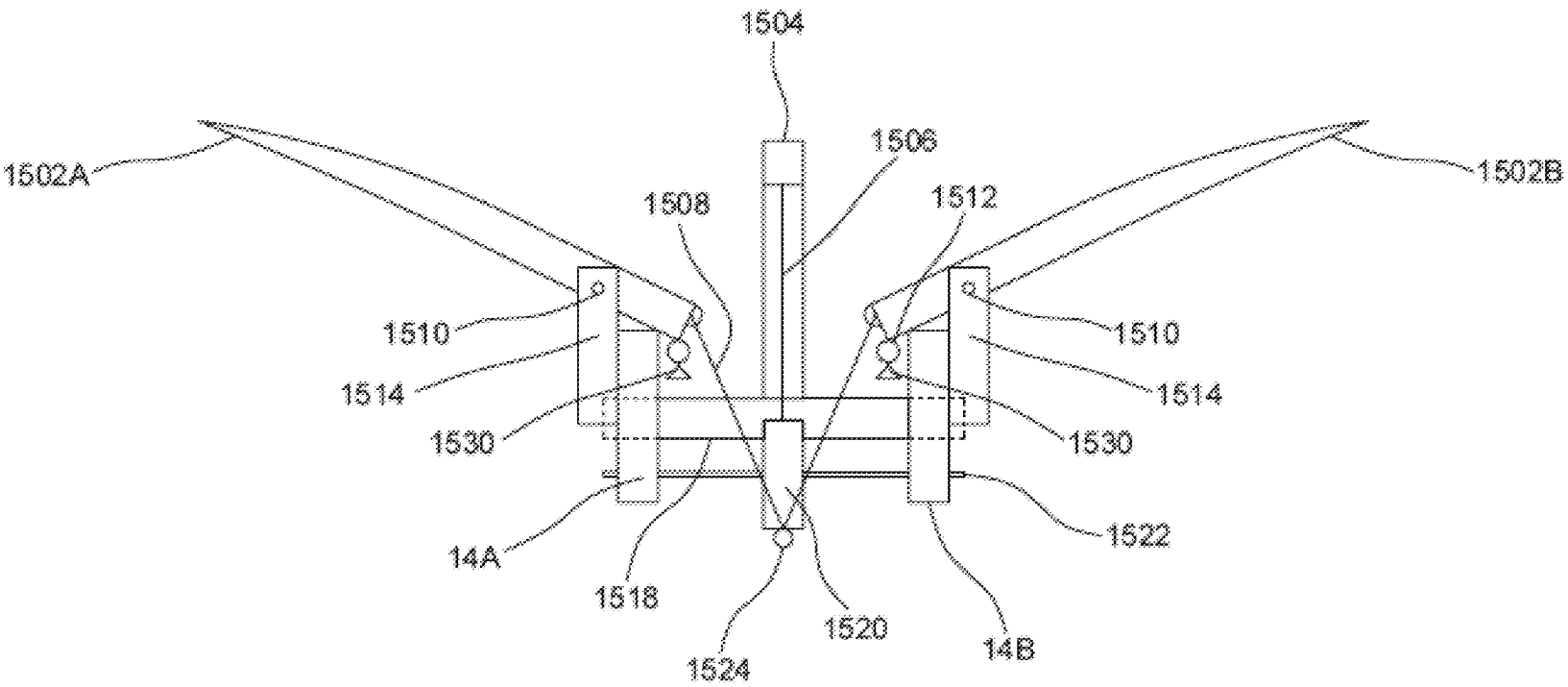
FIG. 15 is a front view of the view of the portion of the seesaw of FIG. 14.

FIG. 14 is a top view of a portion of an embodiment of a seesaw 1500 that includes a pair of wings 1502A, 1502B. FIG. 15 is a front view of the portion of the seesaw 1500. The seesaw 1500 is similar to the seesaw 10 of FIG. 1, but the beam 14 of the seesaw 10 is replaced with a first beam 14A that is parallel to a second beam 14B.

The first beam 14A and the second beam 14B are parallel and are aligned class one levers that simultaneously rise and lower. As the beams 14A, 14B rise and lower, the movement of the wings 1502A, 1502B appear to mimic wings of an animal.

The linkage for moving the wings includes a lift link 1504 a lift link cable 1506 two wing cables 1508, two wing pivots 1510, two counterweight bars 1512, four upright wing mounts 1514, a main fulcrum 1518, a wing link 1520, a wing link pivot 1522, five eyebolts 1524, and suspended counterweights from the counterweight bars.

The lift link 1504 is connected to the linkage operated by movement of the foot bar caused by the rider. The lift link 1504 is rotatably mounted on the main fulcrum 1518. Rotation of the lift link 1504 about the main fulcrum 1518 causes the lift link 1504 to pull the lift link cable 1506, which is connected to the lift link 1504 and the wing link 1520 by eyebolts 1524.

The wing link 1520 is rotatably mounted on the wing link pivot 1522. In this way rotation of the lift link 1504 about the main fulcrum 1518 causes rotation of the wing link 1520 about the wing link pivot 1522.

The opposite end of the wing link 1520 is connected to a root end of each wing by a pair of wing cables 1508. The wing cables 1508 are secured to eyelets 1524 on the wing link 1520 and eyelets 1524 on the root ends of the wings 1502A, 1502B.

In this way, rotation of the lift link 1504 rotates the wings 1502A, 1502B in a first direction. To return the wings 1502A, 1502B to their original position, the left link 1504 releases tension on the lift cable 1506 and the counterweights 1530 return the wings 1502A, 1502B to their original orientation.

Figure 16:
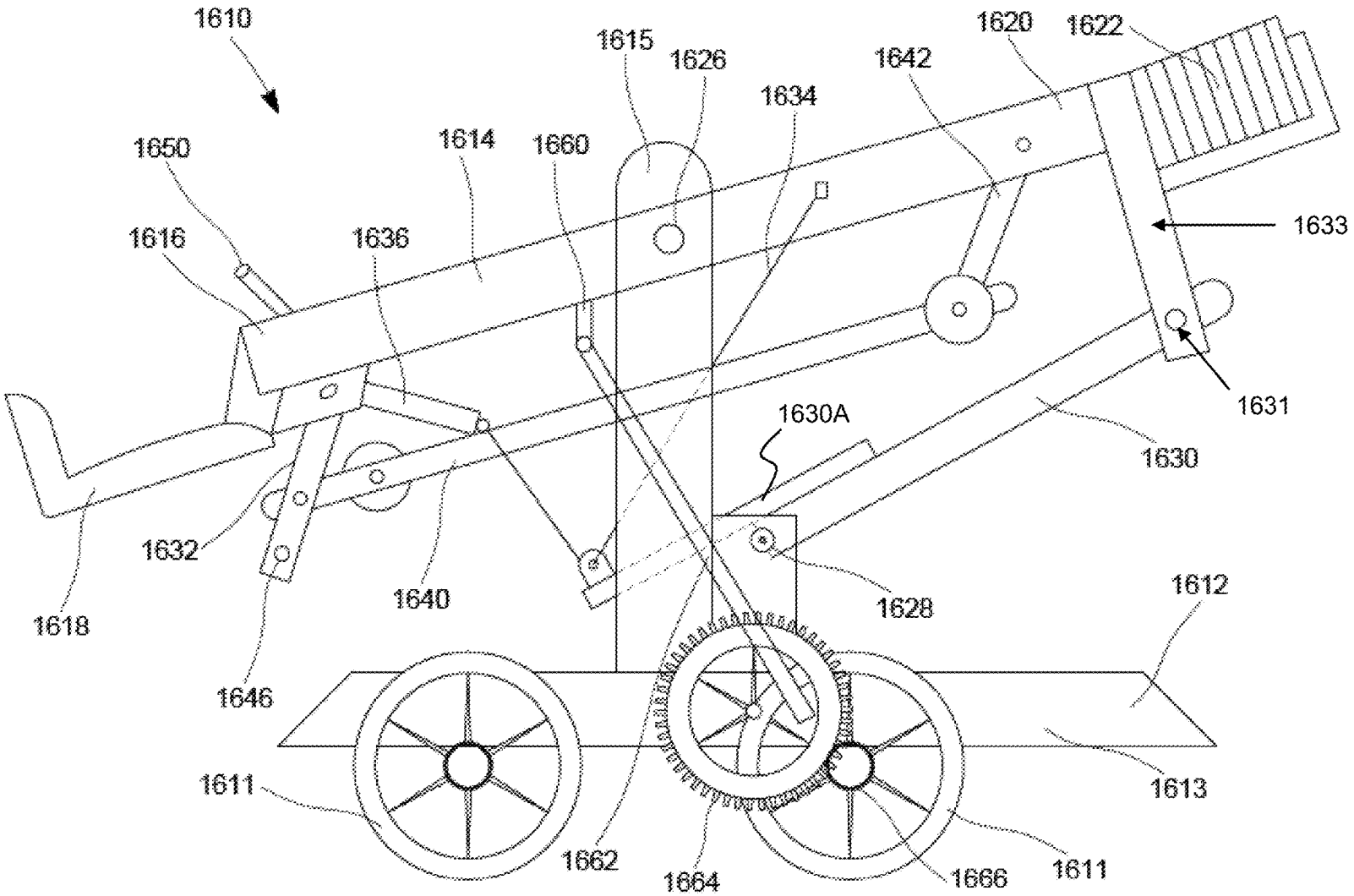
FIG. 16 is a schematic elevation view of an embodiment of a car according to the present disclosure.

Turning now to FIG. 16, an exemplary embodiment of a single rider seesaw car is indicated generally at 1610. The single rider seesaw car provides various advantages over a traditional handcar. For example, a traditional handcar requires significant human effort to press downwardly on a handle to drive the handcar. In contrast, the single rider seesaw car of the present disclosure allows a user to drive the car via a linkage, as described in further detail below, which requires which requires less human effort, resulting in a reduction, or elimination of the necessary arm strength required of the traditional handcar. The single rider seesaw car of the present disclosure is driven in part by the rider's weight, as gravitational potential energy is exchanged for kinetic energy of the linkage, and thus kinetic energy of the car. In some embodiments, the rider may expend minimal effort to drive the single rider seesaw car. The single rider seesaw car 1610 includes a base 1612 and a beam 1614 that is rotatable with respect to the base 1612. A first end 1616 of the beam includes a seat 1618 for a rider. A second end 1620 of the beam includes a load 1622. The beam of the car 1610 is held in the orientation shown in FIG. 16 by the weight of the load 1622 being pulled down by gravity and by a lock arm 1630 that opposes rotation of the beam 1614 due to the weight of the load 1622. Operation of the car 1610 will be discussed in further detail below.

The base 1612 is configured to be supported on one or more pairs of wheels 1611. Note that as illustrated in FIG. 16 with two wheels shown on the same side of base 1612 there would be an additional pair of wheels 1611 on the opposite side of base 1612. In some embodiments, the wheels 1611 are configured to roll along an outdoor ground surface. In some embodiments, the wheels 1611 are configured to roll along an indoor floor surface. The wheels 1611 are configured to be driven by movement of the beam 1614, as described in more detail below.

In FIG. 16, the base 1612 includes a lower portion 1613 with a horizontal lower surface. The base 1612 of FIG. 16 includes a vertically extending portion 1615 with an upper end that is configured to connect to the beam 1614 so the beam may rotate with respect to the base 1612.

In some embodiments, the lower portion 1613 and the vertically extending portion 1615 are not integrally formed. In some embodiments, the lower portion 1613 and the vertically extending portion 1615 are integrally formed.

The beam 1614 has a length measured from the first end 1616 of the beam and the second end 1620 of the beam 1614. In some embodiments, the length of the beam 1614 is 14 feet.

The beam 1614 is pivotably connected to the base 1612 at the fulcrum point 1626, and the beam 1614 is configured to rotate about the fulcrum point 1626. The fulcrum point 1626 is located between the first end 1616 of the beam and the second end 1620 of the beam 1614.

In some embodiments, the fulcrum point 1626 is centered with respect to the length of the beam 1614. In embodiments in which the fulcrum point 1626 is centered with respect to the length of the beam 1614, the mechanical advantage of the car 1610 is derived from movements of various elements of the car 1610.

In some embodiments, a mechanical advantage system includes the car 1610 and at least one other lever machine or mechanical advantage device that may be used to provide an additional mechanical advantage of the mechanical advantage system. In some embodiments, the mechanical advantage system includes the car 1610 and at least one additional linkage, which may be constructed the same as the linkage of car 1610. In some such embodiments, the linkages of the car each contribute to the total mechanical advantage of the mechanical advantage system. In some embodiments of the mechanical advantage system, the linkages of the car are connected in series. The linkages cooperate with each other to drive a single gear. In some embodiments, the linkages may be configured to push or pull the gear in phase with each other. In some embodiments, the linkages may be configured to apply take operate out of phase with each other. In some embodiments, the linkages may be configured to operate 180 degrees out of phase with each other (e.g. one linkage is pulling the gear, while another linkage is pushing the gear).

In some embodiments, the seat 1618 is configured to support at least one rider. In some embodiments, the seat 1618 is configured to support more than one rider. In some embodiments, the seat 1618 includes a safety belt, which is configured to selectively secure a rider to the seat. The seat 1618 may include an ergonomic seat base and seat back to comfortably support the rider(s). In some embodiments the seat 1618 may be mounted securely to the beam, or a beam extension, and may also be within a track assembly with adjustable positioning. In some embodiments the seat 1618 may pivot backward and forward in a rocking motion, balancing on a fulcrum positioned under the rider's seat and adjustable to accommodate each rider. In some embodiments, the seat 1618 may have a variable adjustment for one or more variables. For example, the seat 1618 may have a variable position along a length of the beam. In some embodiments, the seat 1618 may have a variable angle at the point of attachment to the beam.

In some embodiments, the weight of the load 1622 may be a static weight, which has a fixed value. In some embodiments, the weight of the load 1622 may be a dynamic weight, which has a changeable value.

For either static or dynamic loads, the weight of the load 1622 is selected to cause a desired performance of the car 1610.

The desired performance of the car 1610 is to complete a full cycle of rotation from the orientation shown in FIG. 16, in which the seat 1618 is positioned at a height below a height of the load 1622, to an orientation in which the seat is positioned at a height above a height of the load 1622 and to return to the orientation shown in FIG. 16 repetitiously, as the rider has the option of repeating the full cycle.

The car 1610 includes a locking mechanism so the orientation of the beam of the car 1610 is selectively lockable in the orientation shown in FIG. 16. When the locking mechanism is engaged, the beam 1614 is held in the orientation of FIG. 16. When the locking mechanism is disengaged, the beam 1614 is free to move to another orientation.

In the embodiment of FIG. 16, the locking mechanism includes a lock bar 1628 that is secured to the base 1612 and a lock arm 1630 that is connected at a first end to the beam 1614 near the second end 1620 of the beam 1614 using a lock arm support 1633. The lock arm support 1633 houses the lock arm pivot 1631 in various locations. The placement of the lock arm pivot 1631 on the lock arm support 1633 secures the position of the lock arm 1630 on the load end of the beam 1614. The lock arm 1630 has a second end that is configured to engage the lock bar 1628. In some embodiments, the engagement between the lock arm 1630 and the lock bar 1628 is frictional engagement. In some embodiments, the lock arm 1630 includes a recess on its second end to receive the lock bar 1628.

In some embodiments, the car includes a return assist bar (a second bar, not shown) mounted on the base within close proximity to the first lock bar. This return assist bar provides an optional resting point for the lock arm to drop to, when the rider ceases pressure to the foot bar. This return assist bar allows for an even faster return of the beam 1614 to the orientation shown in FIG. 16, compared to the time it would take the beam 1614 to return from the lock bar as shown in FIG. 16. In some embodiments, the base 1612 includes a second bar mechanism that includes a return assist bar.

In some embodiments, the lock arm 1630 further includes one or more additional features such as a latch to secure the lock arm 1630 to the lock bar 1628.

The locking mechanism may be disengaged by lifting the lock arm 1630 with respect to the lock bar 1628. When a rider is seated in the car 1610, the rider may disengage the lock arm 1630 from the lock bar 1628 by operating a linkage, which is included in the car 1610 of FIG. 16.

The linkage of the car 1610 of FIG. 16 includes a first link 1632 having a first end that is pivotably secured to the beam 1614 between the fulcrum 1626 and the first end 1616 of the beam 1614. The first link 1632 has a second end that is free. In some embodiments, a cable 1634 has a first end connected to an arm 1636 of the first link 1632 that is located near the first end of the first link 1632 and that extends perpendicularly from the main axis of the first link 1632. In particular, in FIG. 16, the cable 1634 has a second end connected to the beam 1614. The cable 1634 engages a pulley at the second end of the lock arm 1630. When the car 1610 is in the orientation shown in FIG. 16, the cable 1634 is held in tension. This tension is adjusted in the preparation stage and is actually used to force the foot bar linkage toward the rider for easier access and operation. This tension loads energy to a foot bar 1646 of the first link 1632 enabling an instantaneous response from the lock arm.

Rotation of the first link 1632 in a first direction pulls the cable 1634 to cause the second end of the lock arm 1630 to disengage the lock bar 1628 and to allow the load 1622 to rotate the beam 1614 such that the seat 1618 moves upwardly.

According to at least one embodiment, to provide further stability and to improve performance of the car 1610, the linkage can include a first cross bar 1640 and a second link 1642 that is connected to the first link 1632 by the first cross bar 1640.

The second end of the first link 1632 further includes the foot bar 1646. The rider may push against the foot bar 1646 to cause the first link 1632 to rotate to pull the cable 1634, to disengage the lock arm 1630 from the lock bar 1628.

The second link 1642 has a first end that is pivotably secured to the beam 1614 between the second end 1620 of the beam 1614 and the location at which the first link 1632 is secured to the beam 1614. The cross bar 1644 has a first end that is secured to the second end of the first link 1632 and a second end that is secured to a second end of the second link 1642.

The links 1632, 1642 are free to rotate as pendulums. The swinging motion of the links 1632, 1642 in unison helps to keep the beam 1614 oscillating for a period of time from an orientation in which the seat is at a height that is above a height of the load to an orientation in which the seat is at a height that is below the height of the load. The beam will continue to oscillate as long as the rider continues to apply periodic pressure to the foot bar. Failure to apply the repeated pressure to the foot bar will result in the beam returning to the orientation shown in FIG. 16. As long as the links 1632, 1642 are kept in proper motion, there will be oscillation of the beam 1614 of the car 1610. When the force applied to the foot bar ceases, the rider will return to their initial position shown in FIG. 16.

The motion of the car 1610 can be intuitive to riders who are familiar with using a swing, with back-and-forth timing. The rider sits in the seat 1618, holds handles 1650 securely, and places their feet on the foot bar 1646.

The function of hand operation requires the rider to pull back the handles 1650 of the assembly toward the rider with a minimal or maximized force, as desired, and then allow the handle to return to be pulled back again. Hand operation may function by incorporating the handle onto the foot bar linkage assembly, or function independently to power and control similar linkage assemblies along the full length of the beam.

In some embodiments, the car 1610 may be configured to oscillate in response to the rider moving the foot bar a distance of between approximately 5 inches and 9 inches. By limiting the length of the rider's leg stroke, it is easier for the rider to reach the maximum point of the leg stroke when moving the foot bar, and if the rider's leg is fully extended, the rider may be naturally inclined to take a standing position on the foot bar. The rider standing on the foot bar would be counterproductive to the goal of continued oscillation of the beam 1614 of the car 1610.

In some embodiments, the car 1610 is specifically foot-driven, as opposed to hand-operated. In some embodiments, the car may instead be hand-operated. Such hand-operated embodiments of the car may be used by riders of different physical abilities or physical limitations. For example, a hand-operated embodiment of the car may be used by a rider with limited or no use of their legs.

When the rider pushes the foot bar 1646 a short distance (which may be, for example, between approximately 5 inches and approximately 9 inches in some embodiments), and with adequate (minimal) force, the lock arm 1630 will raise, via the cable 1634, and the rider rises. This is because the lock arm 1630 disengaged from the lock bar 1628, and the weight of the lock arm is now shared between the lift cable and the lock arm pivot.

It is at this point that the rider will have control of the motion of the machine.

As long as the rider applies a continuous pressure to the foot bar, the rider will reach the maximum height allowed (approximately at the 9:30 position (halfway between the 9 o'clock and 10 o'clock positions on a clockface if it were superposed over the beam when the beam is viewed from the side), and will remain in that position, until the rider ceases to apply pressure to the foot bar, at which point the rider will be returning to its original position.

Additionally, in some embodiments if the rider wishes to achieve rapid oscillation of the beam, when the rider removes the pressure from the foot bar, the removal of the pressure should be done with a rapid action, and a total cease of pressure, not just a slow reduction. Slow removal of pressure from the foot bar would be similar to dragging a user's feet on the ground as the users rides a swing.

When the rider ceases to apply pressure to the foot bar and removes the pressure from the foot bar in a swift and rapid way, the weight of the lock arm gets dropped onto the lock bar. Important dynamics of the weight transfer occurs at this time. The weight was previously shared between the lift cable and the pivot of the lock arm. Instead, the weight is now shared between the pivot of the lock arm, and the resting point of the lock arm upon the lock bar. The lock bar now assumes a significant share of the lock arm weight, resulting in an increase in the return speed of the load, rising upward to its original position.

The present configuration assumes an expected amount of (minimal) friction between the lock arm, and the lock bar. The lock bar may be in a fixed/static position, or may be free to rotate within the securing points to the base. There are various options available to reduce this friction. One such embodiment mounts onto the lock bar, to accommodate the sliding lock arm across the lock bar to reduce friction, and the noise associated with the friction.

As the rider removes the pressure applied to the foot bar 1646, the lock arm 1630 lowers to rest on the lock bar 1628 and drags across the lock bar 1628 (as the load end of the beam rises) until either (1) the lock arm 1630 drops into the locked position against the lock bar 1628, or (2) the rider returns pressure to the foot bar 1646 to continue oscillating movement of the car 1610.

To ensure safety during operation of the car 1610, the rider must always ensure that the lock arm 1630 is securely engaged on the lock bar 1628 before attempting to dismount the car 1610. In some embodiments, there may be additional locking mechanisms available to the rider to secure the beam 1614 in the orientation shown in FIG. 16.

The operation gives the rider total control over how fast, and how high the machine functions, and the repetition is what forces the machine's continuous rocking motion.

Any position-shifting movements of the rider become mechanical advantage enhancers, including (1) mechanical advantage with leg movement and leg weight displacement during operation and (2) any suspended/pivoting physical pendulums, with or without additional weight. There are other mechanical advantage enhancers not mentioned here, but within the scope of the present disclosure, that either increase the power output, or reduce the power input required.

By shifting weight along the beam as described herein, a user may effect oscillation of the beam of the car.

Oscillation of the beam causes rotation of at least one of the wheels 1611. A first driving link 1660 and a second driving link 1662 are rotatably connected to each other. A first end of the first driving link 1660 is connected to the beam 1614 between the fulcrum point 1626 and the first end 1616 of the beam at which the rider sits on the seat 1618. The second end of the first driving link 1660 is connected to a first end of the second driving link 1662. A second end of the second driving link 1662 is connected to a driving gear 1664. The driving gear 1664 has teeth that engage teeth on a driven gear 1666 that is connected to an axis of one of the wheels 1611. When the beam 1614 oscillates, the first driving link 1660 rotates with respect to the second driving link 1662, and the second driving link 1662 causes rotation of the driving gear 1664 about the axis of the driving gear 1664. Rotation of the driving gear 1664 causes rotation of the driven gear 1666 in the opposite direction. Because the driven gear 1666 is rotationally fixed to one of the wheels 1611, rotation of the driven gear 1666 effects rotation of that respective one of the wheels 1611.

In some embodiments, the driven gear is rotationally fixed to at least one of the wheels 1611. For example, the driven gear may be rotationally fixed to a pair of wheels 1611 that are connected by an axle.

Figure 17:
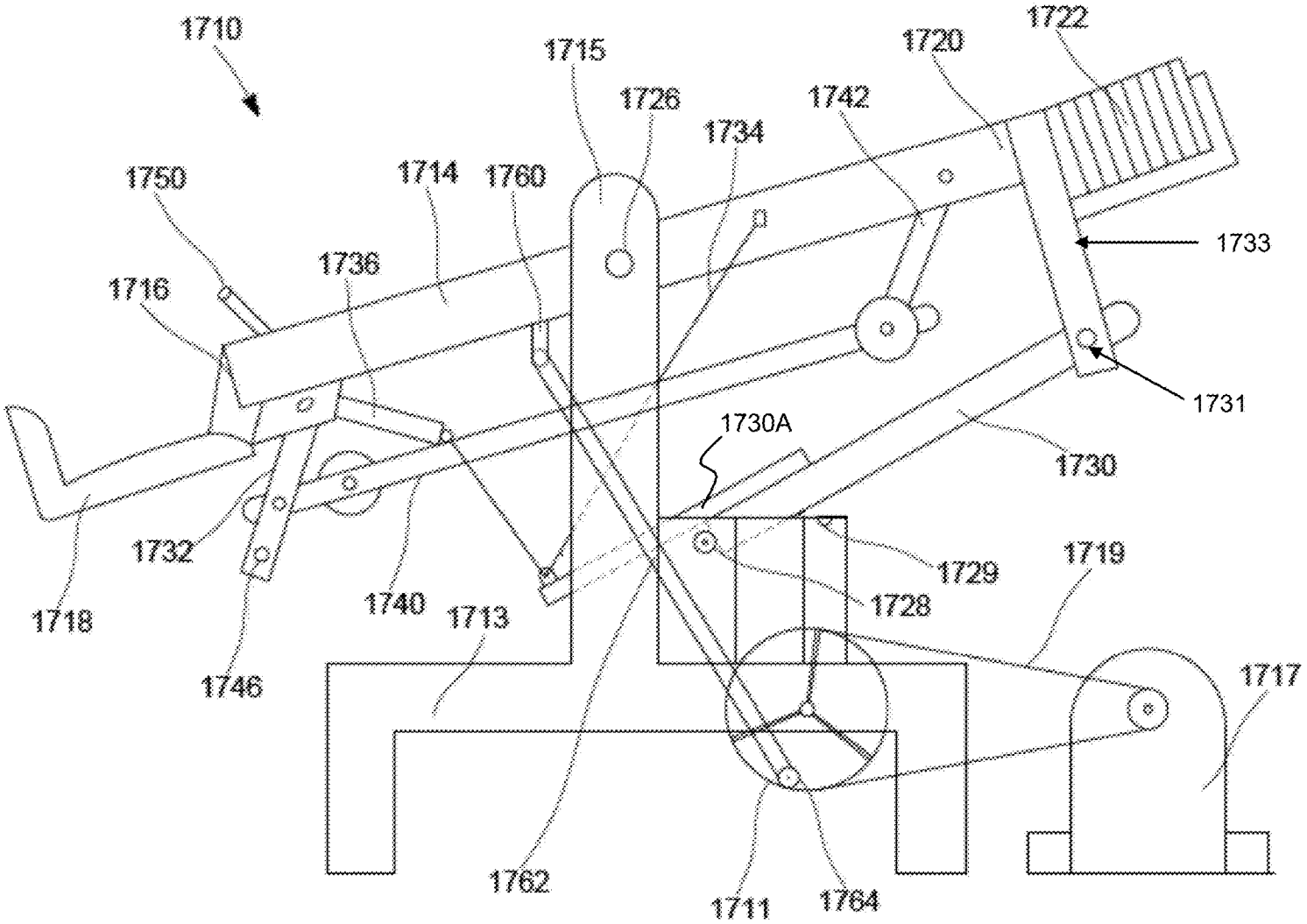
FIG. 17 is a schematic elevation view of an embodiment of a power generation system according to the present disclosure.

Turning now to FIG. 17, an exemplary embodiment of a single rider seesaw power generation system is indicated generally at 1710. The single rider seesaw power generation system 1710 includes a base 1712 and a beam 1714 that is rotatable with respect to the base 1712. A first end 1716 of the beam includes a seat 1718 for a rider. A second end 1720 of the beam includes a load 1722. The beam 1714 of the power generation system 1710 is held in the orientation shown in FIG. 17 by the weight of the load 1722 being pulled down by gravity and by a lock arm 1730 that opposes rotation of the beam 1714 due to the weight of the load 1722. Operation of the power generation system 1710 will be discussed in further detail below.

The base 1712 is configured to support a wheel 1711 that is connected to a generator 1717 by a belt 1719. Belt 1719 may also be any other suitable flexible connection, such as a chain drive or the like. The wheel 1711 is configured to be driven by movement of the beam 1714, as described in more detail below.

In FIG. 17, the base 1712 includes a lower portion 1713 with a horizontal lower surface. The base 1712 of FIG. 17 includes a vertically extending portion 1715 with an upper end that is configured to connect to the beam 1714 so the beam may rotate with respect to the base 1712.

In some embodiments, the lower portion 1713 and the vertically extending portion 1715 are not integrally formed. In some embodiments, the lower portion 1713 and the vertically extending portion 1715 are integrally formed.

The beam 1714 has a length measured from the first end 1716 of the beam and the second end 1720 of the beam 1714. In some embodiments, the length of the beam 1714 is 14 feet.

The beam 1714 is pivotably connected to the base 1712 at the fulcrum point 1726, and the beam 1714 is configured to rotate about the fulcrum point 1726. The fulcrum point 1726 is located between the first end 1716 of the beam and the second end 1720 of the beam 1714.

In some embodiments, the fulcrum point 1726 is centered with respect to the length of the beam 1714. In embodiments in which the fulcrum point 1726 is centered with respect to the length of the beam 1714, the mechanical advantage of the power generation system 1710 is derived from movements of various elements of the car 1610.

In some embodiments, a mechanical advantage system includes the power generation system 1710 and at least one other lever machine or mechanical advantage device that may be used to provide an additional mechanical advantage of the mechanical advantage system. In some embodiments, the mechanical advantage system includes the power generation system 1710 and at least one additional power generation system, which may be constructed the same as the power generation system 1710. In some such embodiments, the power generation system 1710 and the additional power generation system(s) each contribute to the total mechanical advantage of the mechanical advantage system. In some embodiments of the mechanical advantage system, the power generation system and the additional power generation system(s) are connected in series.

In some embodiments, the seat 1718 is configured to support at least one rider. In some embodiments, the seat 1718 is configured to support more than one rider. In some embodiments, the seat 1718 includes a safety belt, which is configured to selectively secure a rider to the seat. The seat 1718 may include an ergonomic seat base and seat back to comfortably support the rider(s). In some embodiments the seat 1718 may be mounted securely to the beam, or a beam extension, and may also be within a track assembly with adjustable positioning. In some embodiments the seat 1718 may pivot backward and forward in a rocking motion, balancing on a fulcrum positioned under the rider's seat and adjustable to accommodate each rider. In some embodiments, the seat 1718 may have a variable adjustment for one or more variables. For example, the seat 1718 may have a variable position along a length of the beam. In some embodiments, the seat 1718 may have a variable angle at the point of attachment to the beam.

In some embodiments, the weight of the load 1722 may be a static weight, which has a fixed value. In some embodiments, the weight of the load 1722 may be a dynamic weight, which has a changeable value.

For either static or dynamic loads, the weight of the load 1722 is selected to cause a desired performance of the power generation system 1710.

The desired performance of the power generation system 1710 is to complete a full cycle of rotation from the orientation shown in FIG. 17, in which the seat 1718 is positioned at a height below a height of the load 1722, to an orientation in which the seat is positioned at a height above a height of the load 1722 and to return to the orientation shown in FIG. 17 repetitiously, as the rider has the option of repeating the full cycle.

The power generation system 1710 includes a locking mechanism so the orientation of the beam of the power generation system 1710 is selectively lockable in the orientation shown in FIG. 17. When the locking mechanism is engaged, the beam 1714 is held in the orientation of FIG. 17. When the locking mechanism is disengaged, the beam 1714 is free to move to another orientation.

In the embodiment of FIG. 17, the locking mechanism includes a lock bar 1728 that is secured to the base 1712 and a lock arm 1730 that is connected at a first end to the beam 1714 near the second end 1720 of the beam 1714 using a lock arm support 1733. The lock arm support 1733 houses the lock arm pivot 1731 in various locations. The placement of the lock arm pivot 1731 on the lock arm support 1733 secures the position of the lock arm 1730 on the load end of the beam 1714. The lock arm 1730 has a second end that is configured to engage the lock bar 1728. In some embodiments, the engagement between the lock arm 1730 and the lock bar 1728 is frictional engagement. In some embodiments, the lock arm 1730 includes a recess on its second end to receive the lock bar 1728.

In some embodiments, the power generation system includes a return assist bar (a second bar) 1729 mounted on the base within close proximity to the first lock bar. This return assist bar 1729 provides an optional resting point for the lock arm to drop to, when the rider ceases pressure to the foot bar. This return assist bar allows for an even faster return of the beam 1714 to the orientation shown in FIG. 17, compared to the time it would take the beam 1714 to return from the lock bar as shown in FIG. 17. In some embodiments, the base 1712 includes a second bar mechanism that includes a return assist bar.

When the return assist bar 1729 is present, the lowering of the lock arm 1730 onto the return assist bar 1729 causes a significant upward thrust of the load end 1720 of the beam 1714, as compared to the thrust when lowering the lock arm 1730 onto the lock bar 1728. The thrust difference is due to the weight of the lock arm 1730, with respect to the position of the load end 1720, and its point of contact with either the lock bar 1728 or the return assist bar 1729.

In normal operation, power generation system 1710 has harmonic motion when moving. The return assist bar 1729 is constructed and arranged to disrupt the normal harmonic motion by increasing the speed at which the load end returns upward and the rider descends quickly. When the return assist bar 1729 is installed, dropping the lock arm 1730 upon the return assist bar 1729 creates a significant upward thrusting motion of the load end of the beam as compared to normal operation. This difference is due to the point of contact of the lock arm 1730 when dropped onto the lock bar 1728, and the point of contact when dropped onto the return assist bar 1729.

In some embodiments, the lock arm 1730 further includes one or more additional features such as a latch to secure the lock arm 1730 to the lock bar 1728.

The locking mechanism may be disengaged by lifting the lock arm 1730 with respect to the lock bar 1728. When a rider is seated in the power generation system 1710, the rider may disengage the lock arm 1730 from the lock bar 1728 by operating a linkage, which is included in the power generation system 1710 of FIG. 17.

The linkage of the power generation system 1710 of FIG. 17 includes a first link 1732 having a first end that is pivotably secured to the beam 1714 between the fulcrum 1726 and the first end 1716 of the beam 1714. The first link 1732 has a second end that is free. In some embodiments, a cable 1734 has a first end connected to an arm 1736 of the first link 1732 that is located near the first end of the first link 1732 and that extends perpendicularly from the main axis of the first link 1732. The cable 1734 has a second end connected to the beam 1714. In particular, in FIG. 17, the cable 1734 engages a pulley at the second end of the lock arm 1730. When the power generation system 1710 is in the orientation shown in FIG. 17, the cable 1734 is held in tension. This tension is adjusted in the preparation stage and is actually used to force the foot bar linkage toward the rider for easier access and operation. This tension loads energy to a foot bar 1746 of the first link 1732 enabling an instantaneous response from the lock arm.

Rotation of the first link 1732 in a first direction pulls the cable 1734 to cause the second end of the lock arm 1730 to disengage the lock bar 1728 and to allow the load 1722 to rotate the beam 1714 such that the seat 1718 moves upwardly.

According to at least one embodiment, to provide further stability and to improve performance of the car 1710, the linkage can include a first cross bar 1740 and a second link 1742 that is connected to the first link 1732 by the first cross bar 1740.

The second end of the first link 1732 further includes the foot bar 1746. The rider may push against the foot bar 1746 to cause the first link 1732 to rotate to pull the cable 1734, to disengage the lock arm 1730 from the lock bar 1728.

The second link 1742 has a first end that is pivotably secured to the beam 1714 between the second end 1720 of the beam 1714 and the location at which the first link 1732 is secured to the beam 1714. The cross bar 1744 has a first end that is secured to the second end of the first link 1732 and a second end that is secured to a second end of the second link 1742.

The links 1732, 1742 are free to rotate as pendulums. The swinging motion of the links 1732, 1742 in unison helps to keep the beam 1714 oscillating for a period of time from an orientation in which the seat is at a height that is above a height of the load to an orientation in which the seat is at a height that is below the height of the load. The beam will continue to oscillate as long as the rider continues to apply periodic pressure to the foot bar. Failure to apply the repeated pressure to the foot bar will result in the beam returning to the orientation shown in FIG. 17. As long as the links 1732, 1742 are kept in proper motion, there will be oscillation of the beam 1714 of the car 1710. When the force applied to the foot bar ceases, the rider will return to their initial position shown in FIG. 17.

The motion of the car 1710 can be intuitive to riders who are familiar with using a swing, with back-and-forth timing. The rider sits in the seat 1718, holds handles 1750 securely, and places their feet on the foot bar 1746.

The function of hand operation requires the rider to pull back the handles 1750 of the assembly toward the rider with a minimal or maximized force, as desired, and then allow the handle to return to be pulled back again. Hand operation may function by incorporating the handle onto the foot bar linkage assembly, or function independently to power and control similar linkage assemblies along the full length of the beam.

In some embodiments, the power generation system 1710 may be configured to oscillate in response to the rider moving the foot bar a distance of between approximately 5 inches and 9 inches. By limiting the length of the rider's leg stroke, it is easier for the rider to reach the maximum point of the leg stroke when moving the foot bar, and if the rider's leg is fully extended, the rider may be naturally inclined to take a standing position on the foot bar. The rider standing on the foot bar would be counterproductive to the goal of continued oscillation of the beam 1714 of the power generation system 1710.

In some embodiments, the power generation system 1710 is specifically foot-driven, as opposed to hand-operated. In some embodiments, the car may instead be hand-operated. Such hand-operated embodiments of the power generation system may be used by riders of different physical abilities or physical limitations. For example, a hand-operated embodiment of the power generation system may be used by a rider with limited or no use of their legs.

When the rider pushes the foot bar 1746 a short distance (which may be, for example, between approximately 5 inches and approximately 9 inches in some embodiments), and with adequate (minimal) force, the lock arm 1730 will raise, via the cable 1734, and the rider rises. This is because the lock arm 1730 disengaged from the lock bar 1728, and the weight of the lock arm is now shared between the lift cable and the lock arm pivot.

It is at this point that the rider will have control of the motion of the machine.

As long as the rider applies a continuous pressure to the foot bar, the rider will reach the maximum height allowed (approximately at the 9:30 position (halfway between the 9 o'clock and 10 o'clock positions on a clockface if it were superposed over the beam when the beam is viewed from the side), and will remain in that position, until the rider ceases to apply pressure to the foot bar, at which point the rider will be returning to its original position.

Additionally, in some embodiments if the rider wishes to achieve rapid oscillation of the beam, when the rider removes the pressure from the foot bar, the removal of the pressure should be done with a rapid action, and a total cease of pressure, not just a slow reduction. Slow removal of pressure from the foot bar would be similar to dragging a user's feet on the ground as the users rides a swing.

When the rider ceases to apply pressure to the foot bar, and removes the pressure from the foot bar in a swift and rapid way, the weight of the lock arm gets dropped onto the lock bar. Important dynamics of the weight transfer occurs at this time. The weight was previously shared between the lift cable and the pivot of the lock arm. Instead, the weight is now shared between the pivot of the lock arm, and the resting point of the lock arm upon the lock bar. The lock bar now assumes a significant share of the lock arm weight, resulting in an increase in the return speed of the load, rising upward to its original position.

The present configuration assumes an expected amount of (minimal) friction between the lock arm, and the lock bar. The lock bar may be in a fixed/static position, or may be free to rotate within the securing points to the base. There are various options available to reduce this friction. One such embodiment mounts onto the lock bar, to accommodate the sliding lock arm across the lock bar to reduce friction, and the noise associated with the friction.

As the rider removes the pressure applied to the foot bar 1746, the lock arm 1730 lowers to rest on the lock bar 1728 and drags across the lock bar 1728 (as the load end of the beam rises) until either (1) the lock arm 1730 drops into the locked position against the lock bar 1728, or (2) the rider returns pressure to the foot bar 1746 to continue oscillating movement of the power generation system 1710.

To ensure safety during operation of the power generation system 1710, the rider must always ensure that the lock arm 1730 is securely engaged on the lock bar 1728 before attempting to dismount the power generation system 1710. In some embodiments, there may be additional locking mechanisms available to the rider to secure the beam 1714 in the orientation shown in FIG. 17.

The operation gives the rider total control over how fast, and how high the machine functions, and the repetition is what forces the machine's continuous rocking motion.

Any position-shifting movements of the rider become mechanical advantage enhancers, including (1) mechanical advantage with leg movement and leg weight displacement during operation and (2) any suspended/pivoting physical pendulums, with or without additional weight. There are other mechanical advantage enhancers not mentioned here, but within the scope of the present disclosure, that either increase the power output, or reduce the power input required.

By shifting weight along the beam as described herein, a user may effect oscillation of the beam of the power generation system.

Continuous oscillation of the beam 1714 drives the belt or chain drive 1719 of the electric power generator 1717. In particular, oscillation of the beam effects rotation of the wheel 1711. A first driving link 1760 and a second driving link 1762 are rotatably connected to each other. A first end of the first driving link 1760 is connected to the beam 1714 between the fulcrum point 1726 and the first end 1716 of the beam at which the rider sits on the seat 1718. The second end of the first driving link 1760 is connected to a first end of the second driving link 1762. A second end of the second driving link 1762 is connected to a driving gear 1764. The driving gear 1764 has teeth that engage teeth on an inner surface of the wheel 1711. When the beam 1714 oscillates, the first driving link 1760 rotates with respect to the second driving link 1762, and the second driving link 1762 effects rotation of the wheel 1711 about the axis of the wheel 1711. Rotation of the wheel 1711 drives rotation of the belt or chain drive 1719 about a wheel 1770 of the power generator 1717. The power generator 1717 includes circuitry configured to convert rotation of the wheel 1770 to power. In at least some embodiments, the power generator 1717 may be a conventional off-the-shelf power generator. While certain positions of the driving links 1760 and 1762 along the beam 1714 are illustrated, these are illustrative and their specific positions along the beam for optimal function of the seesaw can be determined by an end user or operator.

As illustrated in FIGS. 1-9 and 16-19, the beam of the seesaw is generally positioned with the center of the beam pivotably secured to the vertically extending portion connected to the base. Having the fulcrum centered in the pivot provides balanced harmonic motion when the rider engages the seesaw. In some embodiments, the fulcrum of the seesaw, i.e., the beam, may be positioned such that the pivot is closer to one of the two ends of the fulcrum. Off-balance fulcrums generally provide for increased speed at the far end from the pivot point compared to balanced fulcrums at the end with the counterweight as the counterweight has a greater linear travel distance when elevated. Classic examples of off-balance fulcrums include trebuchet catapults and compound levers. In a compound lever, the resistance from one lever in a system of levers acts as effort for the next, and the applied force is transferred from one lever to the next. This is premised on fulcrums being off-set, or off-balanced. The use of off-balanced fulcrums in seesaws as disclosed herein may provide for more efficient power generation.

Mechanical advantage devices according to the present disclosure may be configured to generate power, such as electrical power, in various ways. In some embodiments, a mechanical advantage device of the present disclosure operates a bellows to generate power. For example, the beam of the mechanical advantage device may be attached to an upper arm of a bellows, which pulls and lifts the upper arm to force air out of the bellows and directs the flow of air in-line, or attached to a securely mounted electric generator powered by the fan blades that receive the air and drive the generator. In some embodiments, the generator may be similar to that of a pedal generator.

Figure 18:
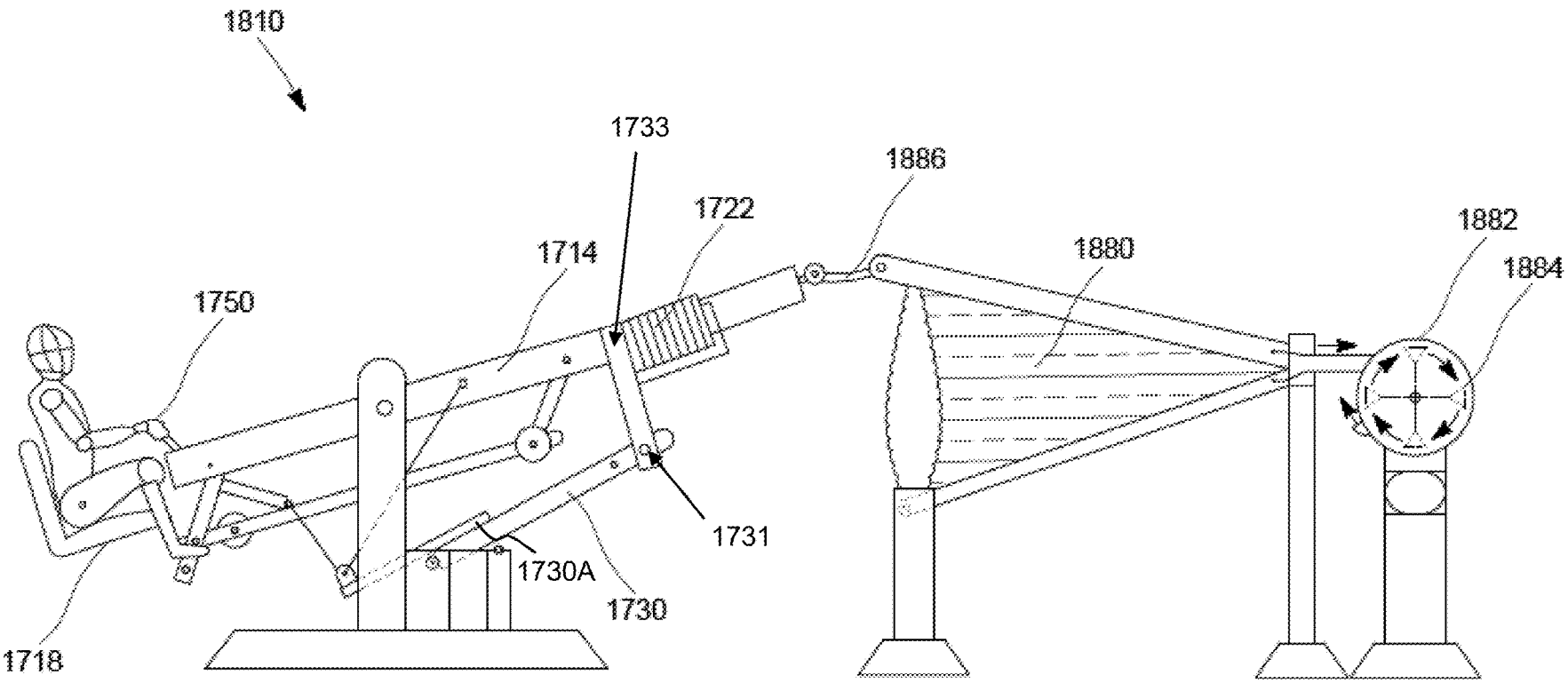
FIG. 18 is a schematic elevation view of an embodiment of a power generation system according to the present disclosure.

Referring now to FIG. 18, a system, generally indicated at 1810, includes a mechanical advantage device of the present disclosure attached to a bellows 1880 that blows air into a fan 1882 of a generator 1884. The mechanical advantage device includes similar features as the embodiment of FIG. 17, with like feature numbers indicating like features. A link 1886 connects the second end 1720 of the beam 1714 with the bellows 1880.

Figure 19:
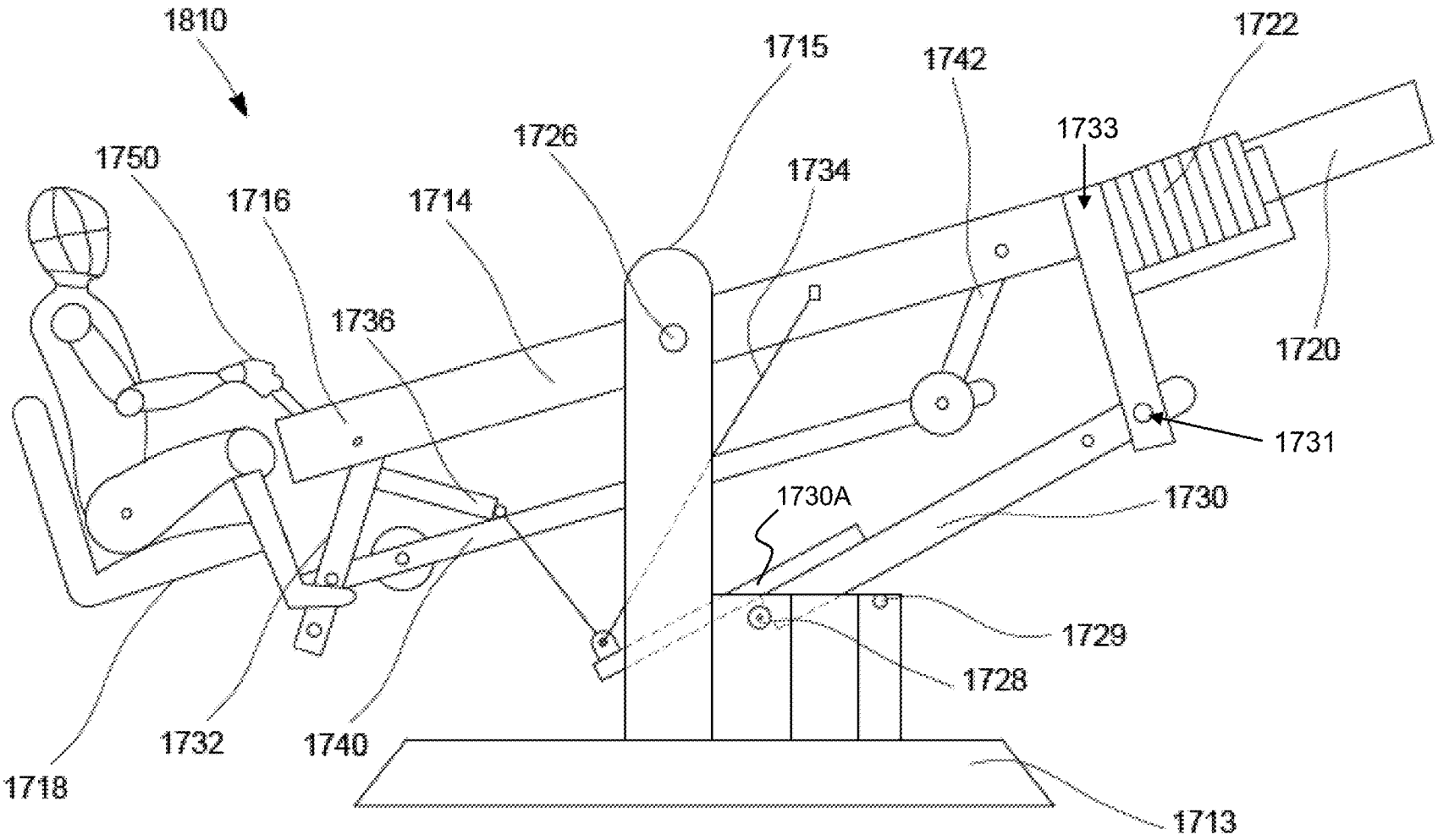
FIG. 19 is a partial schematic elevation view of an embodiment of a power generation system according to the present disclosure.
Figure 20:
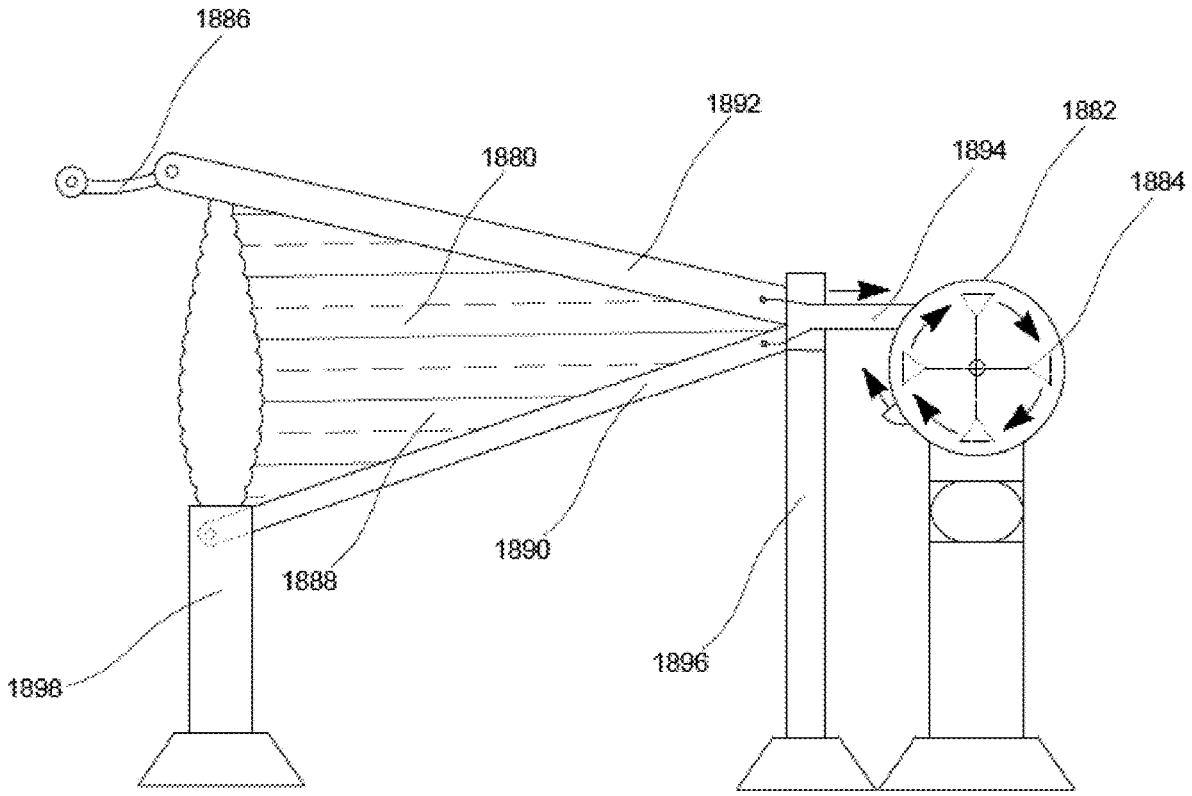
FIG. 20 is a partial schematic elevation view of an embodiment of a power generation system according to the present disclosure.

Referring now to FIG. 19, the bellows 1880 and generator 1884 are shown in more detail. The bellows 1880 includes a chamber defined by deformable walls 1888, a first solid wall 1890, and a second solid wall 1892. The deformable walls 1888 connect the first solid wall 1890 to the second solid wall 1892. The solid walls 1890, 1892 are pivotable with respect to each other, with an end of the first solid wall 1890 and the end of the second solid wall 1892 each secured to a first post 1896. The first solid wall 1890 is additionally supported at its other end by a second post 1898. In this way, the orientation of the first solid wall 1890 is fixed during operation of the bellows, and the second solid wall 1892 may be pivoted towards the first solid wall 1890 to expel air from the bellows.

The second solid wall 1890 is connected to the second end 1720 of the beam 1714 by the link 1886. The link 1886 may be in the form of a cable.

The bellows 1880 includes a nozzle 1894 at an end of the chamber configured to direct air expelled from the chamber towards the fan 1882 of the generator 1884. As the rider causes the beam 1714 to oscillate, the oscillation of the beam 1714 pulls the link 1886 up or down, thereby causing the second solid wall 1892 of the bellows to be pivoted towards the first wall or away from the first wall. In this way, oscillation of the beam 1714 repetitively opens and closes the bellows. The air expelled by the bellows is directed by the nozzle to the fan 1882 of the generator. Rotation of the fan 1882 due to the air flow from the nozzle of the bellows causes the generator 1884 to generate electric power.

The generator 1884 includes circuitry configured to convert rotation of the fan 1882 to power. In at least some embodiments, the power generator 1884 may be a conventional off-the-shelf power generator.

Figure 21:
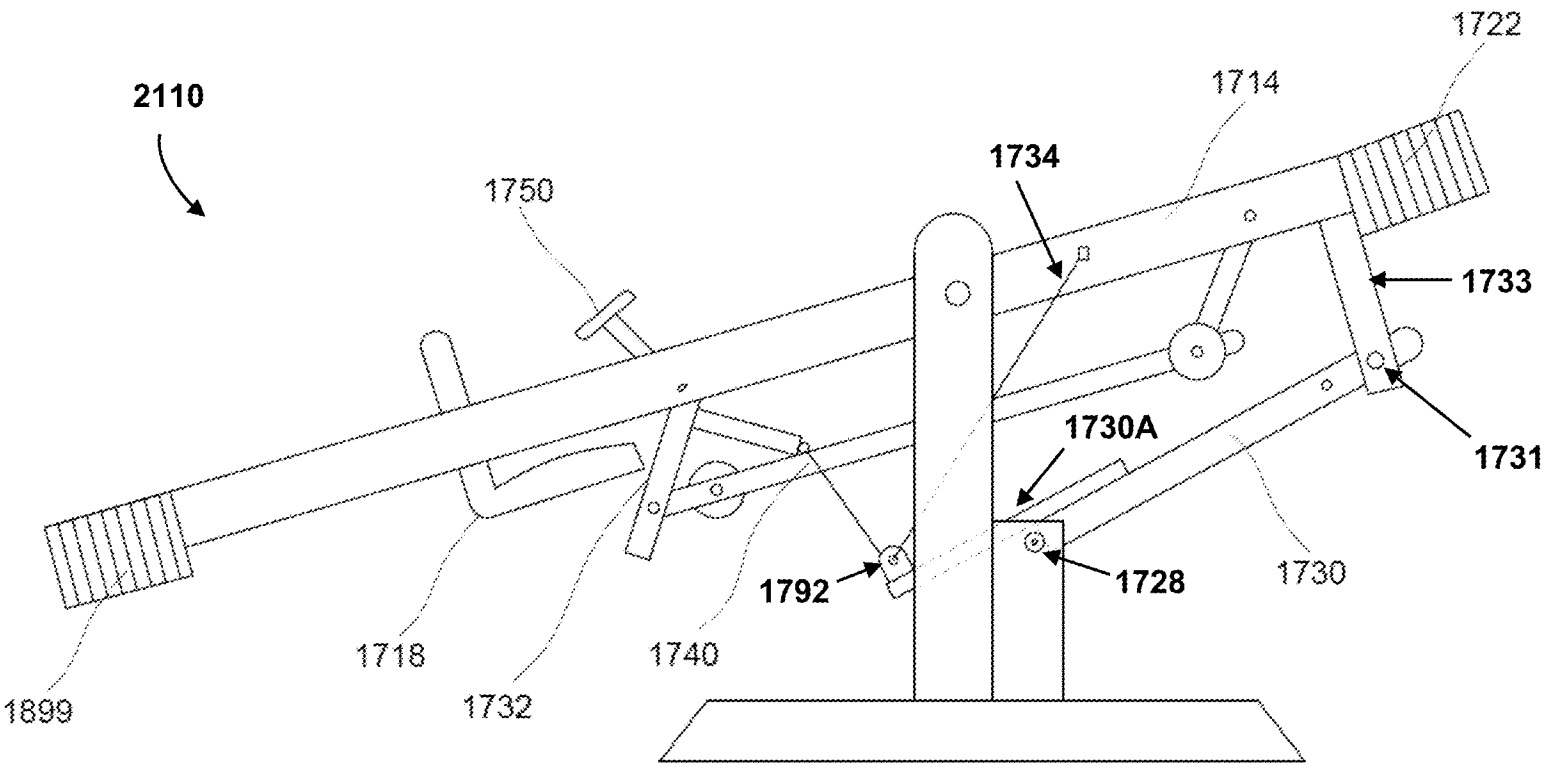
FIG. 21 is a schematic elevation view of an embodiment of a seesaw having a compound counterweight system according to the present disclosure.

As further illustrated in FIGS. 1-9 and 16-19, the seat of the seesaw embodiments disclosed herein is typically positioned at a terminal end of the beam opposite the counterweight load at the opposing terminal of the beam with the two loads spaced equally from the fulcrum point. This is premised on using the balance of the seesaw at the fulcrum point to control the motion of the rider and the counterweight load. This near-balance formulation may also be applied to a much longer machine where the rider is seated elsewhere along the beam and positioned closer to the fulcrum. As illustrated in FIG. 21, the terminal end of the beam 1714 with the rider includes a secondary load 1899. In this configuration, the position of the rider on the beam 1714 and the rider's mass creates a differential that will determine the needed mass of the secondary load to achieve balanced operation. Without wishing to be bound by any particular theory, as the rider's position approaches the fulcrum point, the mass of the secondary load increases, approaching the mass of the main load 1722 on the opposing terminal end of the beam, i.e., the two loads would be identical if the rider was seated at the fulcrum point. With the change in the position of the rider as illustrated in FIG. 21, the positions of the cables 1734, pulleys 1792, and locking mechanisms, e.g., lock bar 1728 and lock arm 1730, used to actuate and control the seesaw 2110 will also change such that the seesaw 2110 functions effectively from the rider's new seated position on the beam 1714. In some embodiments, the masses of one or both of the main load 1722 or the secondary load 1899 may be static or variable.

It should be observed that the seesaws disclosed herein are particularly suited for use by a single rider. Because the beam of the seesaw is held securely in the first orientation until a rider disengages the locking mechanism, the rider may safely mount the seat of the seesaw before disengaging the locking mechanism.

Having thus described at least one embodiment of the present disclosure, various alternations, modifications and improvements will readily occur to those skilled in the art. Such alterations, modifications and improvements are intended to be within the scope and spirit of the disclosure. Accordingly, the foregoing description is by way of example only and is not intended to be limiting. The disclosure's limit is defined only in the following claims and equivalents thereto.

What is claimed is:

1. A system for generating power, comprising:

a base;

a driving assembly including a beam pivotably connected to the base at a fulcrum between a first end of the beam and a second end of the beam;

a load at the second end of the beam;

a lock bar secured to the base;

a lock arm having a first end pivotably connected to the beam by a lock arm support disposed near the second end of the beam and having a second end that is configured to engage the lock bar;

a first link having a first end pivotably secured to the beam between the fulcrum and the first end of the beam and a second end that is free; and a cable having a first end connected to the first link near the first end of the link and having a second end connected to the second end of the lock arm, wherein rotation of the first link in a first direction pulls the cable to cause the second end of the lock arm to disengage the lock bar and to allow the load to rotate the beam such that a seat positioned at the end of the beam moves upwardly;

a first driving link having a first end rotatably connected to the beam; and a second driving link having a first end rotatably connected to a second end of the first driving link and a second end; and a power generator operatively coupled to the second end of the second driving link.

2. The power generation system of claim 1, further comprising a wheel driven by the second driving link; and a belt or chain drive connecting the wheel to the power generator.

3. The power generation system of claim 1, wherein a fulcrum point of the beam is centered with respect to a length of the beam.

4. The power generation system of claim 1, wherein a fulcrum point of the beam is disposed closer to the first end of the beam than the second end of the beam.

5. The power generation system of claim 1, wherein a fulcrum point of the beam is disposed closer to the second end of the beam than the first end of the beam.

6. The power generation system of claim 1, wherein a position of the seat at the first end of the beam is adjustable towards the fulcrum.

7. The power generation system of claim 1, wherein a mass of the load at the second end of the beam is static.

8. The power generation system of claim 1, wherein a mass of the load at the second end of the beam can be adjusted.

9. The power generation system of claim 1, wherein an engagement between the lock arm and the lock bar is frictional.

10. The power generation system of claim 1, wherein the lock arm comprises a recess disposed at the second end adapted to receive the lock bar.

11. The power generation system of claim 1, wherein the cable engages a pulley coupled to the second end of the lock arm.

12. The power generation system of claim 1, further comprising a seat disposed at the first end of the beam.

13. The power generation system of claim 12, wherein rotation of the first link in the first direction further allows the load to rotate the beam such that the seat moves upwardly.

14. The power generation system of claim 13, wherein a second end of the first driving link comprises a foot bar constructed and arranged to rotate the first driving link.

15. The power generation system of claim 14, wherein pressure applied to the foot bar causes harmonic oscillation of the beam.

16. The power generation system of claim 1, further comprising handles disposed near the seat and operatively coupled to the beam.

17. The power generation system of claim 16, wherein the handles are further operatively coupled to the foot bar.

18. The power generation system of claim 1, further comprising a return assist bar mounted on the base and disposed near the first lock bar.

19. The power generation system of claim 1, wherein a second end of the second driving link is operatively coupled to the power generator.

* * * * *